US010577885B2

(12) United States Patent
Drobniak et al.

(10) Patent No.: US 10,577,885 B2
(45) Date of Patent: Mar. 3, 2020

(54) CONFIGURABLE BOP STACK

(71) Applicant: Hydril USA Distribution LLC, Houston, TX (US)

(72) Inventors: David Joseph Drobniak, Houston, TX (US); Viral Shah, Houston, TX (US); Wanda Roark, Houston, TX (US)

(73) Assignee: Hydril USA Distribution LLC, Houston, TX (US)

( * ) Notice: Subject to any disclaimer, the term of this patent is extended or adjusted under 35 U.S.C. 154(b) by 1 day.

(21) Appl. No.: 15/706,989

(22) Filed: Sep. 18, 2017

(65) Prior Publication Data

US 2018/0080301 A1 Mar. 22, 2018

Related U.S. Application Data

(60) Provisional application No. 62/395,784, filed on Sep. 16, 2016.

(51) Int. Cl.
*E21B 33/064* (2006.01)
*E21B 34/16* (2006.01)
(Continued)

(52) U.S. Cl.
CPC ..... *E21B 33/064* (2013.01); *E21B 33/061* (2013.01); *E21B 34/16* (2013.01); *E21B 41/0021* (2013.01)

(58) Field of Classification Search
CPC ..... E21B 33/064; E21B 33/06; E21B 33/061; E21B 34/16; E21B 41/0021
(Continued)

(56) References Cited

U.S. PATENT DOCUMENTS 6,276,450 B1 8/2001 Seneviratne
7,216,714 B2 * 5/2007 Reynolds ..... E21B 33/035 137/557
(Continued)

FOREIGN PATENT DOCUMENTS

CN 201391268 Y 1/2010
EP 2 697 477 A1 2/2014
(Continued)

OTHER PUBLICATIONS

"Phuel Modular Blowout Preventer," Pressure Control Equipment, Phuel Oil Tools, pp. 1-4 (Year: 2016).*
(Continued)

*Primary Examiner* — Anna M Momper
*Assistant Examiner* — Patrick F Lambe
(74) *Attorney, Agent, or Firm* — Hogan Lovells US LLP

(57) ABSTRACT

The present disclosure is directed to systems and methods for a configurable blowout preventer (BOP) system for use in oil and gas operations. According to an embodiment, a BOP system can include two or more modular BOP ram cavity sets, each of the BOP ram cavity sets having at least one BOP ram cavity; one or more frame levels, each of the frame levels separating each of the BOP ram cavity sets and coupling each of the BOP ram cavity sets together; and a plurality of hydraulic piping fluidly connected to each of the BOP ram cavity sets, the plurality of hydraulic piping configured to drive operation of the BOP ram cavity sets.

17 Claims, 16 Drawing Sheets

(51) Int. Cl.
*E21B 33/06* (2006.01)
*E21B 41/00* (2006.01)

(58) Field of Classification Search
USPC ..... 166/85.4
See application file for complete search history.

(56) References Cited

U.S. PATENT DOCUMENTS

| | | | |
|---|---|---|---|
| 8,127,852 | B2 | 3/2012 | Judge et al. |
| 8,640,775 | B2 | 2/2014 | Kotrla et al. |
| 8,770,298 | B2 | 7/2014 | Gustafson |
| 8,960,306 | B2 | 2/2015 | Smith |
| 9,163,472 | B2 | 10/2015 | Childers et al. |
| 2014/0048731 | A1 | 2/2014 | Leuchtenberg et al. |

FOREIGN PATENT DOCUMENTS

| | | | |
|---|---|---|---|
| WO | 2006/023690 | A2 | 3/2006 |
| WO | 2017/192388 | A1 | 11/2017 |

OTHER PUBLICATIONS

"Cost-Effective Control," Drilling—Pressure Control—Well Intervention Equipment, Rig Concept & Design, Retrieved from Internet URL: http://web.archive.org/web/20151001170220/http://www.axonep.com/cost-effective-control, pp. 1-3 (Jun. 8, 2018).

"Phuel Modular Blowout Preventer," Pressure Control Equipment, Phuel Oil Tools, pp. 1-4 (2016).

"The Design Philosophy Behind NOV Rig Systems' 20K BOP," National Oilwell Varco, Retrieved from Internet URL: https://www.nov.com/News_and_Events/Events/Events_Detail/Design_Philosophy_of_NOV_Rig_System_s_20K_BOP.aspx, on Jun. 21, 2018, pp. 1-2 (May 1, 2015).

Taylor, W.M., et al., "Modular Marine BOP Stack," SPE/IADC Drilling Conference, pp. 1-2 (Feb. 1986) (Abstract).

International Search Report and Written Opinion issued in connection with corresponding PCT Application No. PCT/US2017/052082 dated Jan. 9, 2018.

* cited by examiner

CONFIGURABLE BOP STACK

CROSS-REFERENCE TO RELATED APPLICATIONS

This application claims benefit of U.S. Provisional Application No. 62/395,784 filed Sep. 16, 2016 entitled "CONFIGURABLE BOP STACK" which is incorporated by reference in its entirety.

BACKGROUND

1. Technical Field

This disclosure relates generally to drilling, and more particularly to systems and methods for a configurable blow out preventer (BOP) stack that allows an end user to swiftly and easily change the quantity of BOP cavities on a BOP stack based upon particular drilling requirements.

2. Background

Oil and gas extraction remains a critical component of the world economy in spite of increasing challenges regarding the accessibility and safety of oil and gas exploitation. Drilling at offshore locations to extract oil and gas from under the sea floor is performed at ever increasing water depths.

Subsea drilling for oil and gas typically involves the use of a vessel, which can be, for example, a drill ship or a platform on the surface of the sea, with a riser extending to near the sea floor. The bottom end of the riser is attached to a lower marine riser package (LMRP), which contains, among other things, control pods intended to control components of the drilling system near the sea floor. Below the riser is typically positioned a stack, which includes an LMRP and a lower stack. The lower stack includes blowout preventers (BOPs) mounted to a wellhead, with the LMRP attached to a distal end of the riser. During regular operation the lower BOP stack and the LMRP are connected. The drilling pipe extends from the vessel at the sea surface, through the riser, through the BOP, and through the wellhead into a wellbore to the oil producing formation.

As subsea drilling extends into deeper formations, pressures and temperatures increase. With higher pressures, there are greater potential safety and environmental consequences if a well leaks. For decades, limitations of known drilling technology have prevented the oil and gas industry from drilling wells having pressures greater than approximately 15,000 pounds per square inch, resulting in lost benefits to the countries that own the associated oil reserves, the oil and gas industry, and consumers.

During drilling, gas, oil or other well fluids at a high pressure may burst from the drilled formations into the riser. When such an event (which is sometimes referred to as a "kick" or a "blowout") occurs at unpredictable moments, if the burst is not promptly controlled, the well and/or the equipment of the installation may be damaged. The BOPs are installed to seal the well when a blowout event occurs. Typical BOP housings include a vertical well bore and a horizontal ram cavity (or ram guide chamber). Opposing rams in the ram cavity can be translated horizontally into the horizontal ram cavity in order to open and close the well bore and seal the wellbore annulus. Although the above discussion was directed to a subsea well, the same is true for ground wells.

Typical BOP stacks are designed for a single configuration only, having a predetermined number of ram cavities each connected to a single point on a BOP stack frame. For example, typical BOP stacks may have five, six, or seven ram cavities, or may have another number of cavities in other examples. However, the need for a particular number of ram cavities may vary based on individual well programs, client needs, changes in regulation, or changes in mode. For example, in drilling mode, the BOP stack may require more ram cavities, whereas in intervention mode, the BOP stack may require fewer ram cavities.

Thus, it may be desirable to provide systems and methods for easily configuring BOP stacks having alternate ram cavity numbers and configurations.

SUMMARY

The present disclosure provides systems and methods for a configurable blowout preventer (BOP) system for use in oil and gas operations. According to an embodiment, the BOP system can include two or more modular BOP ram cavity sets, each of the two or more modular BOP ram cavity sets having at least one BOP ram cavity. In an embodiment, the BOP system can further include one or more frame levels, each of the one or more frame levels separating each of the two or more modular BOP ram cavity sets and coupling each of the two or more modular BOP ram cavity sets together. In an embodiment, the BOP system can further include a plurality of hydraulic piping fluidly connected to each of the two or more modular BOP ram cavity sets, the plurality of hydraulic piping configured to drive operation of the two or more modular BOP ram cavity sets.

The present disclosure is also directed to a configurable blowout preventer (BOP) system for use in oil and gas operations. In an embodiment, the BOP system can include two or more modular BOP ram cavity sets, the two or more modular BOP ram cavity sets being vertically stacked, and each of the two or more modular BOP ram cavity sets including at least one BOP ram cavity; one or more frame levels, each of the one or more frame levels separating each of the two or more modular BOP ram cavity sets and coupling each of the two or more modular BOP ram cavity sets together; a plurality of hydraulic piping fluidly connected to each of the two or more modular BOP ram cavity sets, the plurality of hydraulic piping configured to drive operation of the two or more modular BOP ram cavity sets; and one or more junction plates positioned on each of the frame levels, the one or more junction plates configured to couple the plurality of hydraulic piping between each of the two or more modular BOP ram cavity sets.

In an embodiment, the BOP system can further include one or more choke valves or kill valves positioned on each of the two or more modular BOP ram cavity sets, wherein the plurality of hydraulic piping is further configured to drive operation of the one or more choke valves or kill valves.

The present disclosure is also directed to a method for assembling a configurable blowout preventer (BOP) system for use in oil and gas operations. In an embodiment, the method can include stacking two or more modular BOP ram cavity sets, each of the two or more modular BOP ram cavity sets including at least one BOP ram cavity; positioning a frame level between each of the two or more modular BOP ram cavity sets and coupling each of the two or more modular BOP ram cavity sets together with the frame level; fluidly connecting a plurality of hydraulic piping to each of the two or more modular BOP ram cavity sets, the plurality of hydraulic piping configured to drive operation of the two or more modular BOP ram cavity sets; and positioning one or more junction plates on each of the frame levels, the one or more junction plates configured to couple the plurality of hydraulic piping between each of the two or more modular BOP ram cavity sets.

Other aspects and features of the present disclosure will become apparent to those of ordinary skill in the art after reading the detailed description herein and the accompanying figures.

BRIEF DESCRIPTION OF DRAWINGS

Some of the features and benefits of the present disclosure having been stated, others will become apparent as the description proceeds when taken in conjunction with the accompanying drawings, in which.

Figure 1:
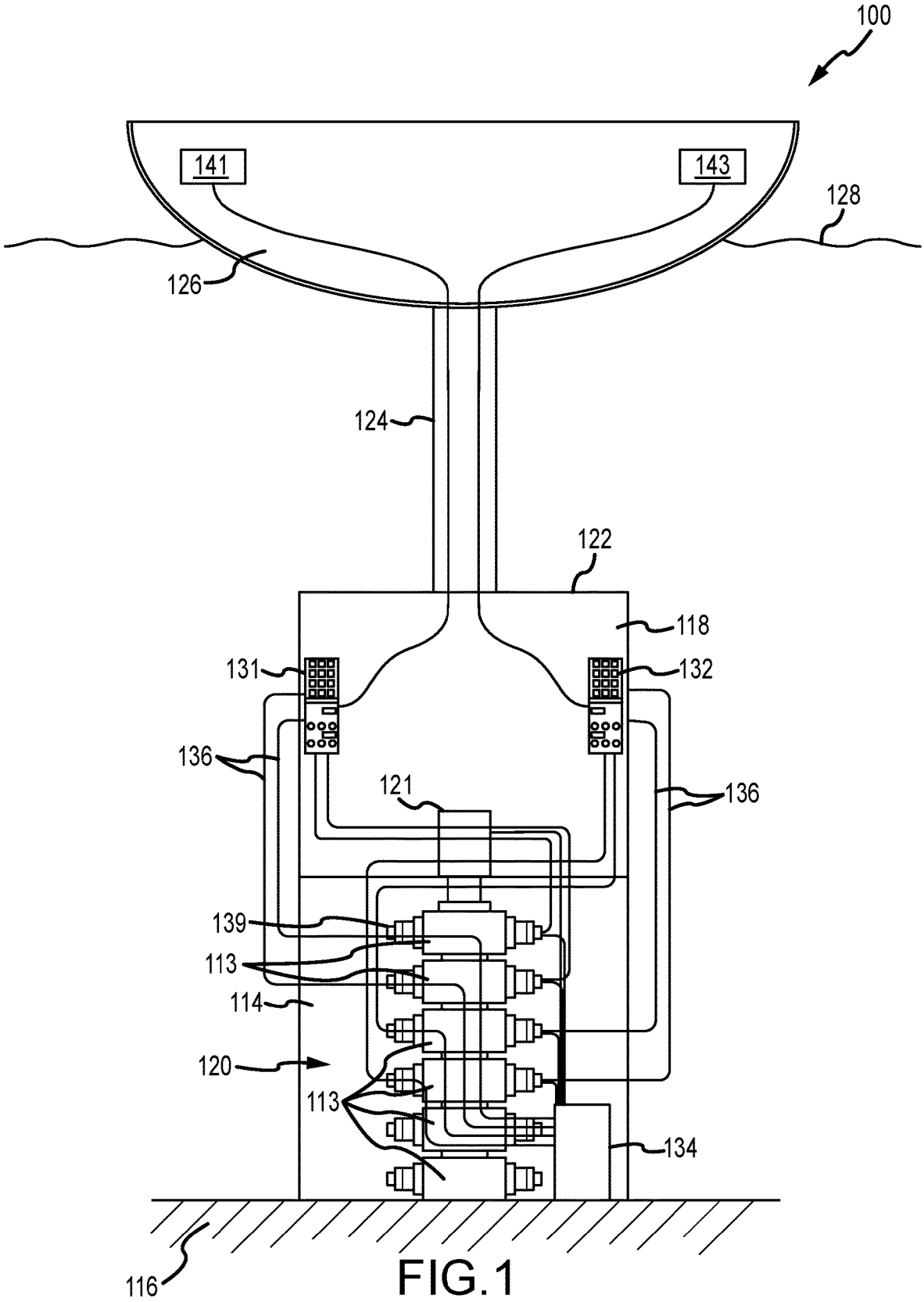
FIG. 1 is a side schematic view of a system for controlling a subsea BOP, according to an embodiment.

While the disclosure will be described in connection with the preferred embodiments, it will be understood that it is not intended to limit the disclosure to that embodiment. On the contrary, it is intended to cover all alternatives, modifications, and equivalents, as may be included within the spirit and scope of the disclosure as defined by the appended claims.

DETAILED DESCRIPTION OF DISCLOSURE

The method and systems of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Described herein are example methods and systems for providing a configurable BOP stack assembly. In particular, stackable modular BOP ram cavity sets are provided, where individual BOP ram cavity sets can be coupled to or detached from other individual BOP ram cavity sets to form BOP stack assemblies having desired BOP ram cavity numbers and configurations, according to particular well site requirements or consumer specifications.

The BOP stack of the present disclosure provides uniquely modular components that allow dual-ram cavity BOPs to be changed out with single ram cavity BOPs and vice versa, as well as the capability to add and remove ram cavities, depending on the needs of the end user. For certain BOPs including, for example, those designed to operate above 15,000 pounds per square inch (psi) and below 20,000 psi of pressure, BOP weight can be a concern. With a configurable stack, the end user has the ability to add or subtract BOP ram cavities based upon individual well site needs. This capability for configuration also provides the end user with a unique advantage in terms of maintenance, in that the end user may swap a damaged or worn BOP with another, operable BOP by swapping an entire BOP section with minimal connections to the BOP stack in its entirety.

This ability to swap individual BOP sections, rather than pulling apart the entire BOP stack, can be achieved by the unique configuration of the modular BOP stack. Traditional BOP stacks are constructed such that a plurality of BOP ram cavities are connected at a single point to the BOP stack frame. For example, the uppermost BOP ram cavity may be attached to the frame at a single point, while the remaining BOP ram cavities below the uppermost BOP ram cavity in the BOP stack may be connected through flange bolts or other connections. This single point of attachment between the uppermost BOP ram cavity and the frame necessitates disassembling all of the BOP ram cavities in order to reconfigure the stack. By instead configuring the BOP stack modularly, as described below, individual BOP sections may be removed or replaced without having to disassemble the entire stack. This reduces down time and saves money.

One advantage associated with a modular and configurable BOP assembly lies in providing an end user with significant flexibility for specific drilling needs. In addition, the present technology provides a one-stop BOP solution to drillers to meet customer needs, and increases manufacturing output by developing a more standard product.

The modular nature of the described configurable BOP stack assemblies advantageously provides for simplified on-site reconfiguration of the BOP stack to include differing numbers of BOP ram cavities, based on individual well site needs, consumer preferences, or drilling regulations. Typical BOP stack assemblies are constructed as permanent or semi-permanent structures, with a single point of connection between the frame and the BOPs, such that reconfiguration of the BOP stack requires significant breakdown and re-welding of the components to form the desired BOP stack configuration. The modular BOP stacks described herein avoid the need for such substantial redesign. Moreover, known BOP stack assemblies are formed, as described below with respect to FIG. 1, from a series of BOP ram cavities stacked abutting each other and connected at a single point on the BOP stack frame. This configuration places significant strain on the hydraulic piping associated with the stack, as well as on the BOP stack frame, and limits the ease with which the BOP stack can be reconfigured.

By instead constructing the BOP stack modularly, as described herein, each BOP ram cavity set can be coupled to a frame level on either side of the BOP ram cavity set. The use of a plurality of frame levels serves to distribute the weight of the BOP stack, such that less stress is placed on the BOP stack frame. Additionally, by providing junction plates at each frame level, the strain imposed on the hydraulic piping in known BOP stacks can be alleviated. The junction plates also allow for simple disconnection of hydraulic piping segments associated with each BOP ram cavity set, such that the BOP stack may be easily reconfigured, as needed.

FIG. 1 shows a system 100 for controlling a subsea BOP 120, according to known systems. The subsea BOP 120 typically includes a lower stack 114 positioned on the sea floor 116 below an LMRP 118. The lower stack 114 is divided into individual BOP ram cavities 113, which can include sealing rams, shear rams, etc. In the illustrated embodiment, the individual BOP ram cavities 113 are shown in a singular stacked configuration, as is known and common in the art. However, as discussed above, such a singular stacked configuration is limited to only such a singular stacked configuration, and does not allow for easy reconfiguration of the stack to add or remove individual BOP ram cavities 113 from the stack. In the illustrated embodiment, removing an individual BOP ram cavity 113 from, or adding an individual BOP ram cavity 113 to, the stack would require modification of the entire BOP 120 frame, and could not be easily achieved on-site. This difficulty in reconfiguration is due in large part to the upper BOP ram cavity in known systems being connected to a single point on the BOP ram stack frame, with the remaining BOP ram cavities connected through flange bolts, for example. The single connection point requires disassembly of all BOP ram cavities in order to reconfigure the BOP ram stack, and accordingly requires significant modification.

The lower stack 114 and the LMRP 118 can be connected to one another by a hydraulic connector 121, which can be controlled to allow disengagement of the LMRP 118 from the lower stack 114. An upper end 122 of the LMRP 118 is connected to a riser 124 that extends from the upper end 122 of the LMRP 118 to a vessel 126 at the surface 128 of the sea. Also included in the system can be a first control pod 131 (often referred to as the yellow control pod) and a second control pod 132 (often referred to as the blue control pod). In the embodiment shown in FIG. 1, the first and second control pods 131, 132 are attached to the LMRP 118. The first control pod 131 and second control pod 132 can be controlled by first and second control cabinets 141, 143, respectively, located on the vessel 126. The vessel 126 can be any appropriate vessel, including, for example, a drill ship or a platform.

Under normal operations, the subsea BOP ram cavities 113 are hydraulically controlled by the first or second control pod 131, 132. Specifically, hydraulic lines 136 run from each of the first and second control pods 131, 132 to individual BOP ram cavities 113 of the BOP 120. Typically, one of the two control pods 131, 132 is responsible for hydraulically controlling the rams in BOP ram cavities 113 through hydraulic lines 136 associated with the respective control pod 131, 132, while the other control pod 131, 132 remains idle. In this way, redundancy is built into the system, because if the control pod 131, 132 actually controlling the rams in BOP ram cavities 113 becomes incapacitated, or otherwise requires maintenance or replacement, the other control pod 131, 132 can continue operation of the rams in BOP ram cavities 113.

In the embodiment shown, each BOP ram cavity 113 can be connected to multiple hydraulic lines 136, each hydraulic line 136 coming from a different control source, including the first control pod 131, the second control pod 132, and the subsea accumulator bottles 134. As shown, which line controls the ram in BOP ram cavity 113 at any given moment can be controlled by valves 139 attached to the BOP ram cavities 113. In the drawings, hydraulic lines 136 are shown connecting each of the first and second control pods 131, 132 and the subsea accumulator bottles 134 to some, but not all, of the BOP ram cavities 113. It is to be understood that in a functioning system, each of the control components 131, 132, 134 can be connected to all of the BOP ram cavities 113, and such a configuration is not shown in the drawing only to improve clarity of the figures.

Figure 2:
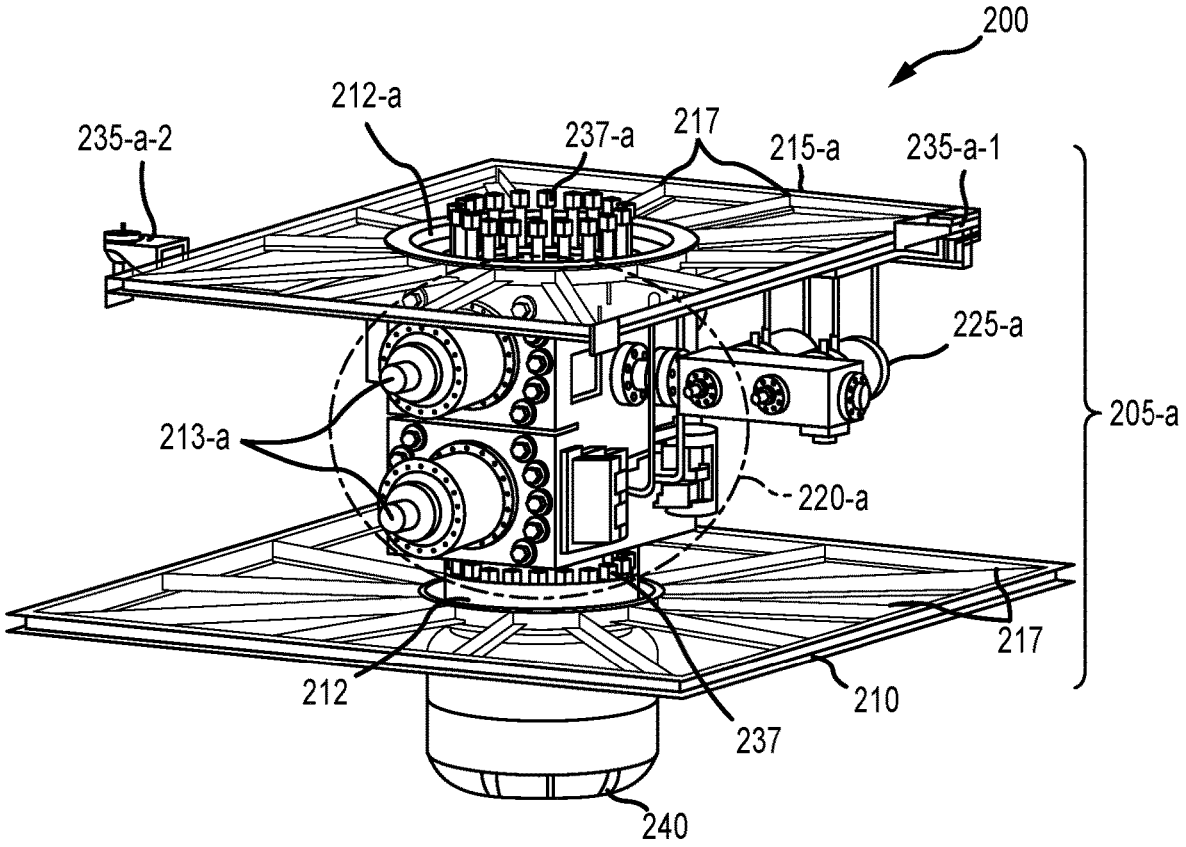
FIG. 2 is a perspective schematic view of a configurable BOP stack, according to an embodiment.
Figure 9:
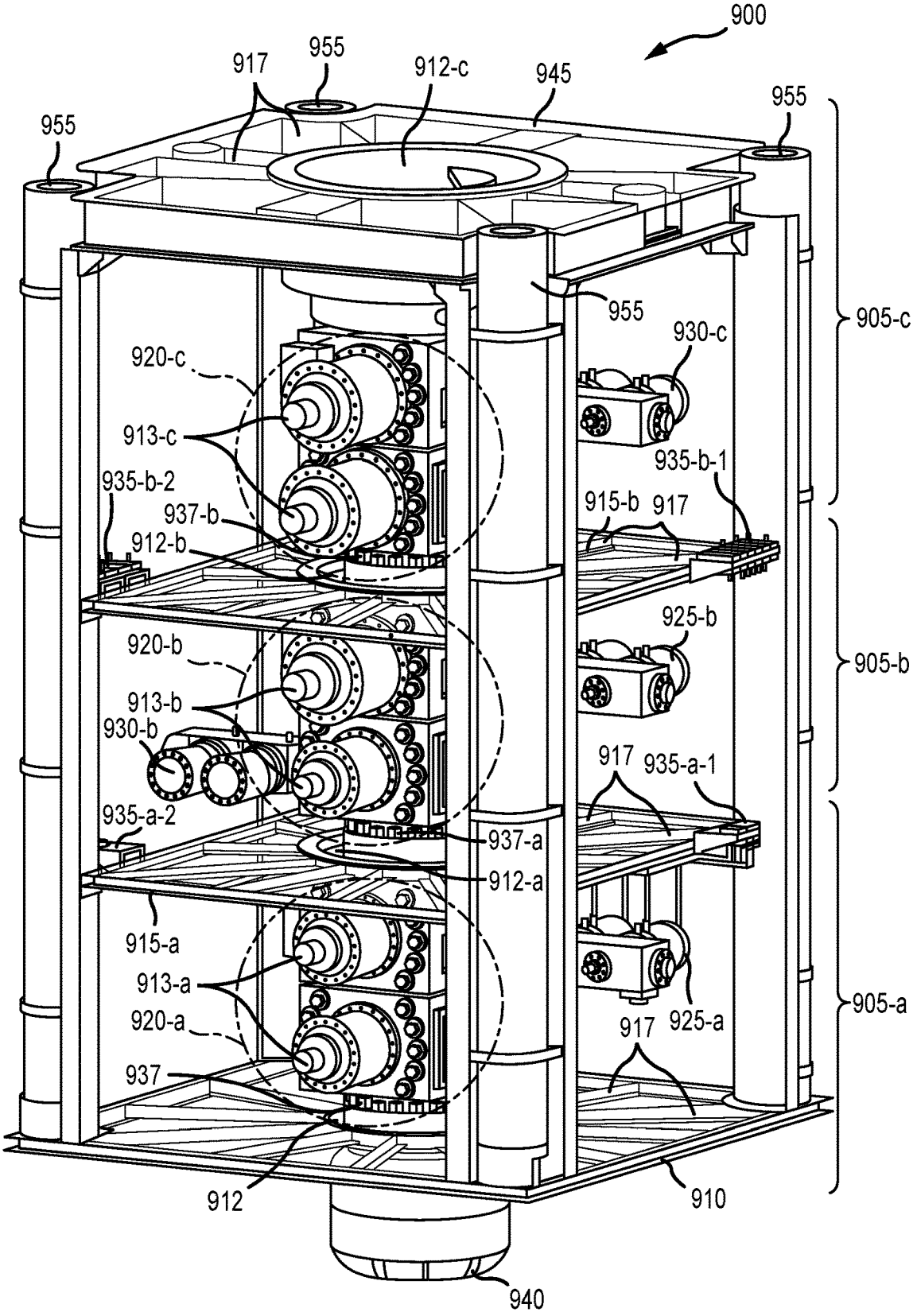
FIG. 9 is a perspective schematic view of a configurable BOP stack, according to an embodiment.

FIG. 2 provides a detailed view of an example 200 of a BOP ram cavity set 205-*a* coupled to a wellhead connector 240, according to an embodiment. Unlike the prior art BOP stack illustrated in FIG. 1, which is limited to a predetermined number of individual BOP ram cavities 213-*a*, the BOP ram cavity set 205-*a* shown in FIG. 2 is one component of a modular BOP stack capable of including varied BOP ram numbers, an example of which is illustrated in FIG. 9 and discussed in more detail below. This modular BOP stack configuration allows for addition and removal of individual BOP ram cavity sets 205-*a* from the BOP stack, such that various BOP stack configurations can be utilized according to situational requirements. For example, as discussed above, when operating in a drilling mode, it may be desirable to provide a greater number of BOP ram cavity sets 205-*a*; alternatively, when operating in an intervention mode, it may be preferable to provide a lesser number of BOP ram cavity sets 205-*a*. Other situations and environments might require alternate numbers of BOP ram cavity sets 205-*a*. An advantage of providing a modular BOP stack includes the ability to easily alter the number of BOP ram cavity sets 205-*a* in the BOP stack, without the need to reconfigure the frame in which the BOP stack is positioned.

In the illustrated example 200, BOP ram cavity set 205-*a* is the bottommost BOP ram cavity set in a BOP stack. As the bottommost BOP ram cavity set, BOP ram cavity set 205-*a* can be coupled to a lower frame level 210 via connectors 237, positioned proximate a wellhead connector 240. BOP 220-*a* can be positioned on a top surface of the lower frame level 210, above and in fluid connection with the wellhead connector 240. Lower frame level 210 can include an opening 212 in the center thereof, having a plurality of connectors 237 centered therein to connect BOP 220-*a* to lower frame level 210. Connectors 237 can include any suitable connector means, such as nuts or quick-connect couplers, to provide an interface for connecting BOP 220-*a* to lower frame level 210. In the illustrated example 200, connectors 237 can form a ring such that a fluid connection between BOP 220-*a* and wellhead connector 240 can be achieved through an open center in the ring of connectors 237. In other embodiments, alternate configurations and numbers of connectors 237 are contemplated.

In the illustrated example 200, lower frame level 210 has a square shape, to accommodate consumer preferences, and includes a circular center opening 212 through which BOP 220-*a* is fluidly connected to wellhead connector 240 via connectors 237. In alternate embodiments, lower frame level 210 can be any shape, such as round, triangular, oblong, rectangular, or any other suitable shape, and can include a central—or, in some embodiments, off-center—opening 212 of any suitable shape, such as square, oblong, triangular, etc., through which BOP 220-*a* can fluidly connect to wellhead connector 240 via connectors 237.

Additionally, in the illustrated example 200, lower frame level 210 includes reinforcing members 217 radiating outwardly from the circular center opening 212 to the outer perimeter of lower frame level 210. Reinforcing members 217 can add structural strength and support to lower frame level 210 to stabilize the BOP stack. In other embodiments, reinforcing members 217 can take any shape, form, or configuration suitable to provide structural strength and support to lower frame level 210, such as including parallel or intersecting reinforcing members, or other suitable configurations.

BOP 220-*a* can include a plurality of individual BOP ram cavities 213-*a*. In the illustrated example 200, BOP 220-*a* includes two BOP ram cavities 213-*a*. BOP ram cavities 213-*a* can include cavities for use with sealing rams, shear rams, or any other suitable ram type. In other embodiments, one, three, or any other suitable number of BOP ram cavities 213-*a* can be included on a BOP 220-*a*. By providing BOPs having different numbers of BOP ram cavities 213-*a*, a BOP stack having a desired even or odd number of BOP ram cavities 213-*a* can be assembled based on particular situational or consumer needs.

BOP 220-*a* can also include one or more choke valves or kill valves 225-*a*. In the illustrated example 200, BOP 220-*a* includes a single choke valve or kill valve 225-*a*, which in some embodiments can be associated with a control pod 132 as illustrated in FIG. 1. For example, when a kick (i.e., an influx of formation fluid) occurs, rig operators or automatic systems, such as control pod 232, can close BOP 220-*a* via. BOP ram cavities 213-*a* to stop the flow of fluids out of the wellbore via wellhead connector 240. Denser mud can then be circulated into the wellbore and out through the choke valve or kill valve 225-*a* at the base of the BOP stack until downhole pressure is overcome. Once "kill weight" mud extends from the bottom of the well to the top, the well has been "killed." If the integrity of the well is intact, drilling may be resumed. Alternatively, if circulation is not feasible, it may be possible to kill the well by "bullheading"—e.g., forcibly pumping-in—the heavier mud from the top of the well through the choke valve or kill salve 225-*a* at the base of the BOP stack.

The modular nature of BOP ram cavity set 205-*a* arises in part from frame level 215-*a*, positioned on top of BOP 220-*a*. In the illustrated example 200, frame level 215-*a* is configured to be of a similar size, shape, and orientation to that of lower frame level 210. In other embodiments, frame level 215-*a* can be any suitable size, shape, or orientation to facilitate stacking of multiple BOP ram cavity sets 205-*a*. Like lower frame level 210, frame level 215-*a* can include a plurality of reinforcing members 217 radiating outwardly to the perimeter of frame level 215-*a* from opening 212-*a* in an interior portion of frame level 215-*a*. In other embodiments, reinforcing members 217 can be arranged in different positions, such as parallel or perpendicular, or any other suitable arrangement. The reinforcing members 217 can provide structural strength and stability to frame level 215-*a* and to the BOP stack as a whole.

The center opening 212-*a* in frame level 215-*a* can include a plurality of connectors 237-*a* extending upwardly from frame level 215-*a*. Connectors 237-*a* can allow for coupling between adjacent BOP ram cavity sets 205-*a*. Additional connectors (not shown) can allow for coupling between the BOP ram cavity set 205-*a* and the frame level 215-*a* through center opening 212-*a*. Such coupling allows the BOP ram cavity set 205-*a* to be attached to the frame level 215-*a* independently from adjacent BOP ram cavity sets, such that independent, modular BOP ram cavity sets are formed and can be added or subtracted from the BOP ram stack for easy configuration and reconfiguration of the stack.

Figure 3:
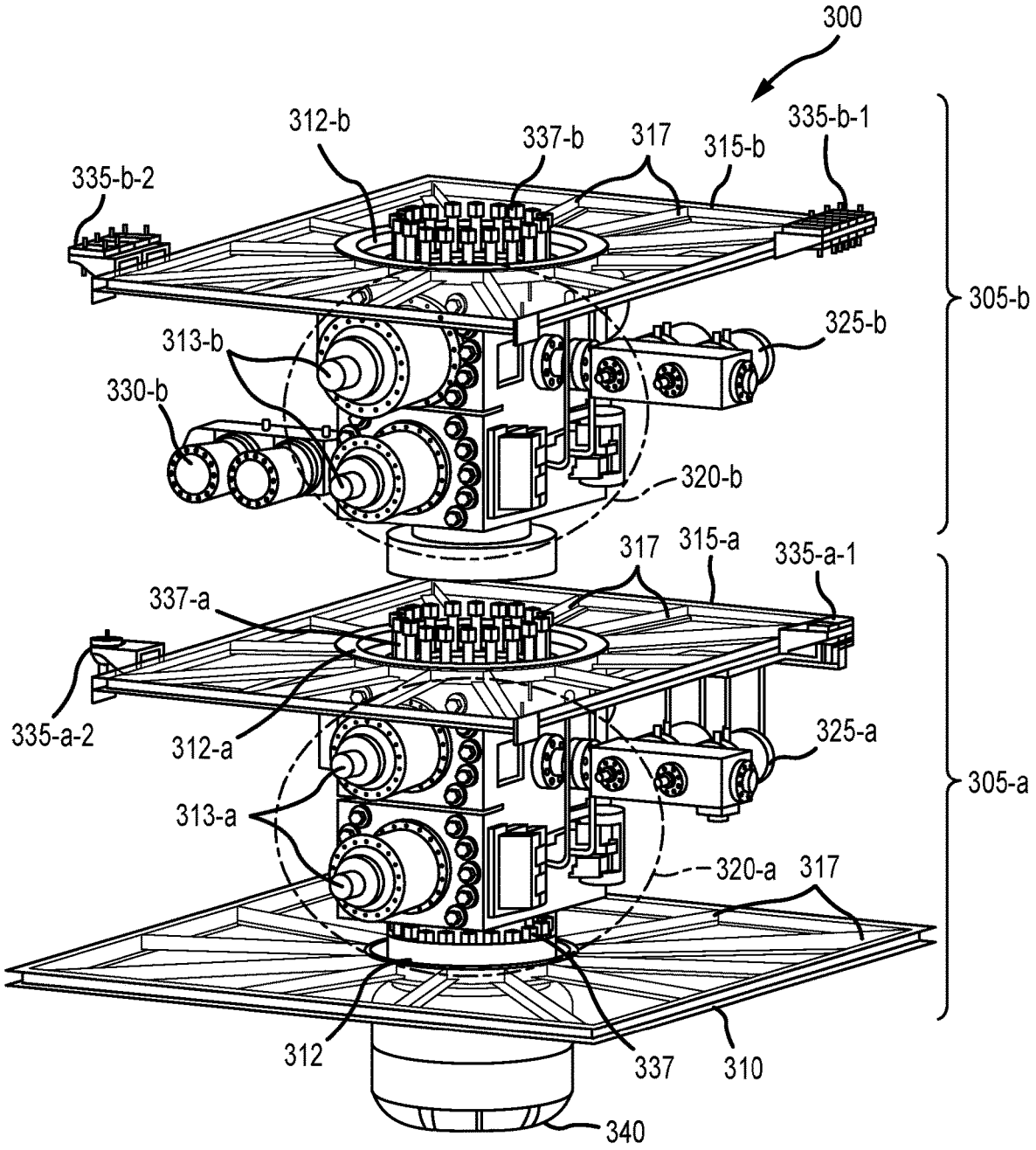
FIG. 3 is a perspective schematic view of a configurable BOP stack, according to an embodiment.

In the illustrated example 200, BOP ram cavity set 205-*a* is the bottommost BOP ram cavity set, and can be coupled to a second BOP ram cavity set 305-*b*, as illustrated and discussed in more detail in FIG. 3, via connectors 237-*a* by positioning the second BOP ram cavity set 305-*b* on top of the bottommost BOP ram cavity set 205-*a*. Connectors 237-*a* can include any suitable connector means, such as nuts or quick-connect couplings, to provide a connection interface between an upper BOP ram cavity set and a lower BOP ram cavity set. Connectors 237-*a* can also be the primary loadbearing element for the plurality of BOP ram cavity sets in the BOP stack. As illustrated in example 200, connectors 237-*a* can be arranged in a circle, with the center of the circle open at opening 212-*a* to facilitate fluid connection between BOP ram cavity set 205-*a* and wellhead connector 240. In other embodiments, other arrangements of connectors 237-*a* are contemplated.

Frame level 215-*a* can further include one or more junction plates 235-*a*-1, 235-*a*-2, which represent another feature that contributes to the modular nature and configurability of the BOP stack. In the illustrated example 200, frame level 215-*a* includes two junction plates 235-*a*-1, 235-*a*-2, respectively positioned proximate the distal ends of opposing corners of frame level 215-*a*. In other embodiments, one, three, or more junction plates can be included, and the junction plates can be positioned anywhere along the perimeter or interior of frame level 215-*a*. In the illustrated example 200, the positions of junction plates 235-*a*-1, 235-*a*-2 were selected to ensure that the hydraulic piping connected by junction plates 235-*a*-1, 235-*a*-2 (discussed in detail with respect to FIGS. 10A-10C) is positioned at a periphery of frame level 215-*a*, and away from the other components of BOP ram cavity set 205-*a*, such as BOP ram cavities 213-*a* and choke valve or kill valve 225-*a*.

Junction plate 235-*b*-1 is positioned in example 200 proximate choke valve or kill valve 225-*a*, in order to connect hydraulic piping running from choke valve or kill valve 225-*a* to a junction plate 335-*b*-1 on a second BOP ram cavity set 305-*b* stacked on top of the bottommost BOP ram cavity set 205-*a*, as illustrated in FIG. 3.

Together, BOP 220-*a*, including BOP ram cavities 213-*a* and choke valve or kill valve 225-*a*; and frame level 215-*a*, including connectors 237-*a*, support members 217, and junction plates 235-*a*-1, 235-*a*-2, can form the modular BOP ram cavity set 205-*a*. Any number of modular BOP ram cavity sets can be stacked and interconnected to form a BOP ram stack having any desired number of individual BOP ram cavities. In the illustrated example 200, the connection of BOP ram cavity set 205-*a* to lower frame level 210 via connectors 237 makes BOP ram cavity set 205-*a* the bottommost BOP ram cavity set.

FIG. 3 illustrates an example of a BOP ram stack 300 including two BOP ram cavity sets 305-*a*, 305-*b*. BOP ram cavity set 305-*a*, and all associated components, can be examples of similarly numbered components as illustrated in the example 200 embodiment in FIG. 2. For example, BOP ram cavity set 305-*a* can be connected to a lower frame level 310 via a plurality of connectors 337. Lower frame level 310 can fluidly couple BOP ram cavity set 305-*a* to wellhead connector 340 through an opening 312 in lower frame level 310. BOP ram cavity set 305-*a* can include BOP 320-*a*, choke valve or kill valve 325-*a*, BOP ram cavities 313-*a*, and frame level 315-*a*. Frame level 315-*a* can include two junction plates 335-*a*-1, 335-*a*-2 in the illustrated example, but one, three, or more junction plates are contemplated in other embodiments.

In the illustrated example BOP stack 300, bottommost BOP ram cavity set 305-*a* is fluidly coupled through opening 312-*a* to a second BOP ram cavity set 305-*b* via connectors 337-*a*. To couple the two BOP ram cavity sets, second BOP ram cavity set 305-*b* can be centered over and brought into alignment with bottommost BOP ram cavity set 305-*a*, and can be coupled to bottommost BOP ram cavity set 305-*a* via connectors 337-*a*.

Second BOP ram cavity set 305-*b* can be a modular BOP ram cavity set similar to bottommost BOP ram cavity set 305-*a*. Like bottommost BOP ram cavity set 305-*a*, second BOP ram cavity set 305-*b* can include BOP 320-*b*, BOP ram cavities 313-*b*, and frame level 315-*b*. Second BOP ram cavity set 305-*b* can include two choke valve or kill valves 330-*b*, according to the illustrated embodiment. In other embodiments, other numbers and combinations of choke valve or kill valves are contemplated. Choke valve or kill valves 325-*b* can be controlled by control pod 132, as illustrated in FIG. 1, and choke valve or kill valves 325-*a* can be controlled by control pod 131, as illustrated in FIG. 1, in some embodiments. In other embodiments, other combinations of control between the control pods 131, 132 and choke valve or kill valves 325-*a*, 325-*b* are contemplated, including control of multiple choke valve or kill valves 325-*a*, 325-*b* by a single control pod 131 or 132. Frame level 315-*b* can include two junction plates 335-*b*-1, 235-*b*-2, which can couple hydraulic piping from choke valve or kill valve 325-*b* and choke valve or kill valve 330-*b* on second BOP ram cavity set 305-*b* with hydraulic piping from choke valve or kill valve 325-*a* on bottommost BOP ram cavity set 305-*a*, as discussed in more detail below with respect to FIGS. 10A-10C.

Figure 4:
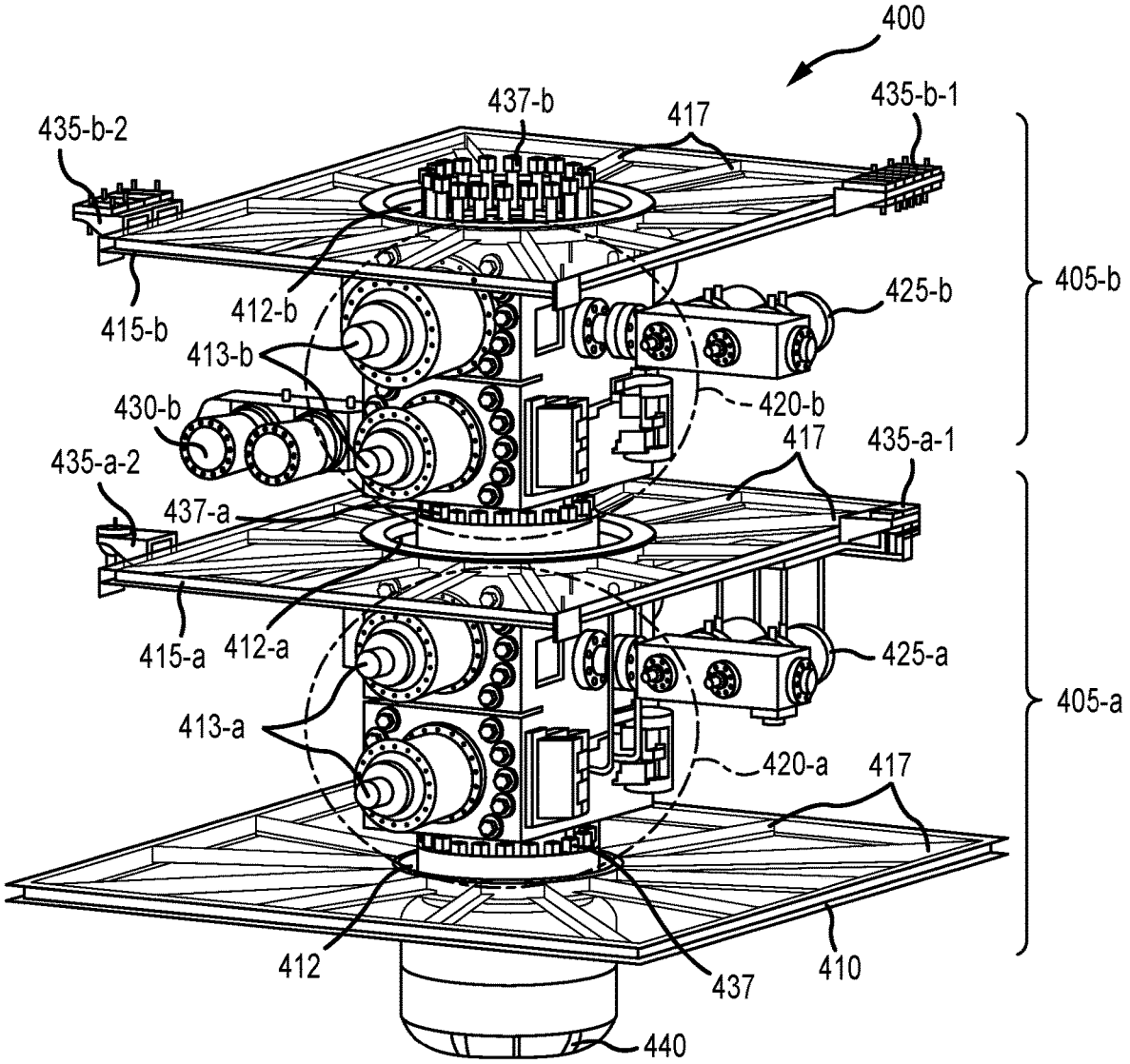
FIG. 4 is a perspective schematic view of a configurable BOP stack, according to an embodiment.

FIG. 4 illustrates an example BOP stack 400 having two BOP ram cavity sets 405-*a*, 405-*b* fluidly coupled together and fluidly connected to a wellhead connector 440, according to an embodiment. BOP ram cavity sets 405-*a*, 405-*b*, and all associated components, can be examples of similarly numbered components as illustrated in the embodiment of FIG. 3. For example, bottommost BOP ram cavity set 405-*a* can be connected to a lower frame level 410 via connectors 437. Lower frame level 410 can fluidly couple bottommost BOP ram cavity set 405-*a* to wellhead connector 440 through an opening 412 in lower frame level 410. Bottommost BOP ram cavity set 405-*a* can include BOP 420-*a*, choke valve or kill valve 425-*a*, BOP ram cavities 413-*a*, and frame level 415-*a*. Frame level 415-*a* can include two junction plates 435-*a*-1, 435-*a*-2 in the illustrated example.

Second BOP ram cavity set 405-*b* can include BOP 420-*b*, BOP ram cavities 413-*b*, and frame level 415-*b*. Second BOP ram cavity set 405-*b* can also include choke valve or kill valves 425-*b* and choke valve or kill valves 430-*b*. Frame level 415-*b* can include two junction plates 435-*b*-1, 435-*b*-2, which can couple hydraulic piping from choke valve or kill valves 425-*b* and choke valve or kill valves 430-*b* on second BOP ram cavity set 405-*b* with hydraulic piping from choke valve or kill valves 425-*a* on bottommost BOP ram cavity set 405-*a*, as discussed in more detail below with respect to FIGS. 10A-10C.

FIG. 4 illustrates the next step in assembly of the BOP stack 400, after second BOP ram cavity set 405-*b* has been centered over and aligned with bottommost BOP ram cavity set 405-*a*. In the illustrated example, bottommost BOP ram cavity set 405-*a* can be coupled through opening 412 to wellhead connector 440 via connectors 437, and second BOP ram cavity set 405-*b* can be coupled through opening 412-*a* to bottommost BOP ram cavity set 405-*a* via connectors 437-*a*. Connectors 437, 437-*a* can facilitate a flush connection at the interface between lower frame level 410 and BOP 420-*a*, and at the interface between frame level 415-*a* and BOP 420-*b*, respectively.

As illustrated in FIG. 4, frame level 415-*b* can include connectors 437-*b* extending upwardly from opening 412-*b* in the center of frame level 415-*b*. Connectors 437-*b* can be configured to receive a third BOP 520-*c*, as illustrated in FIG. 5.

Figure 5:
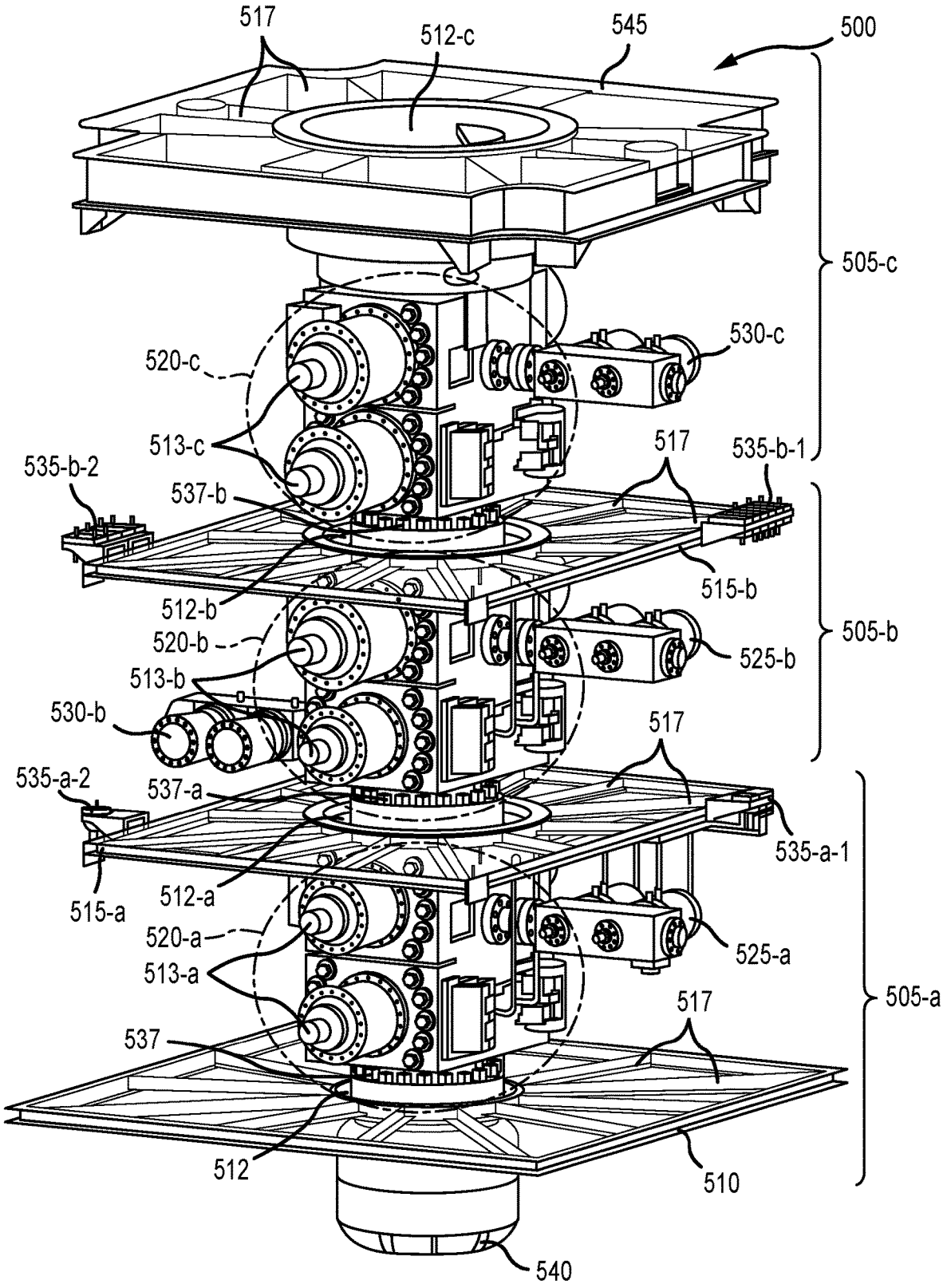
FIG. 5 is a perspective schematic view of a configurable BOP stack, according to an embodiment.
Figure 6:
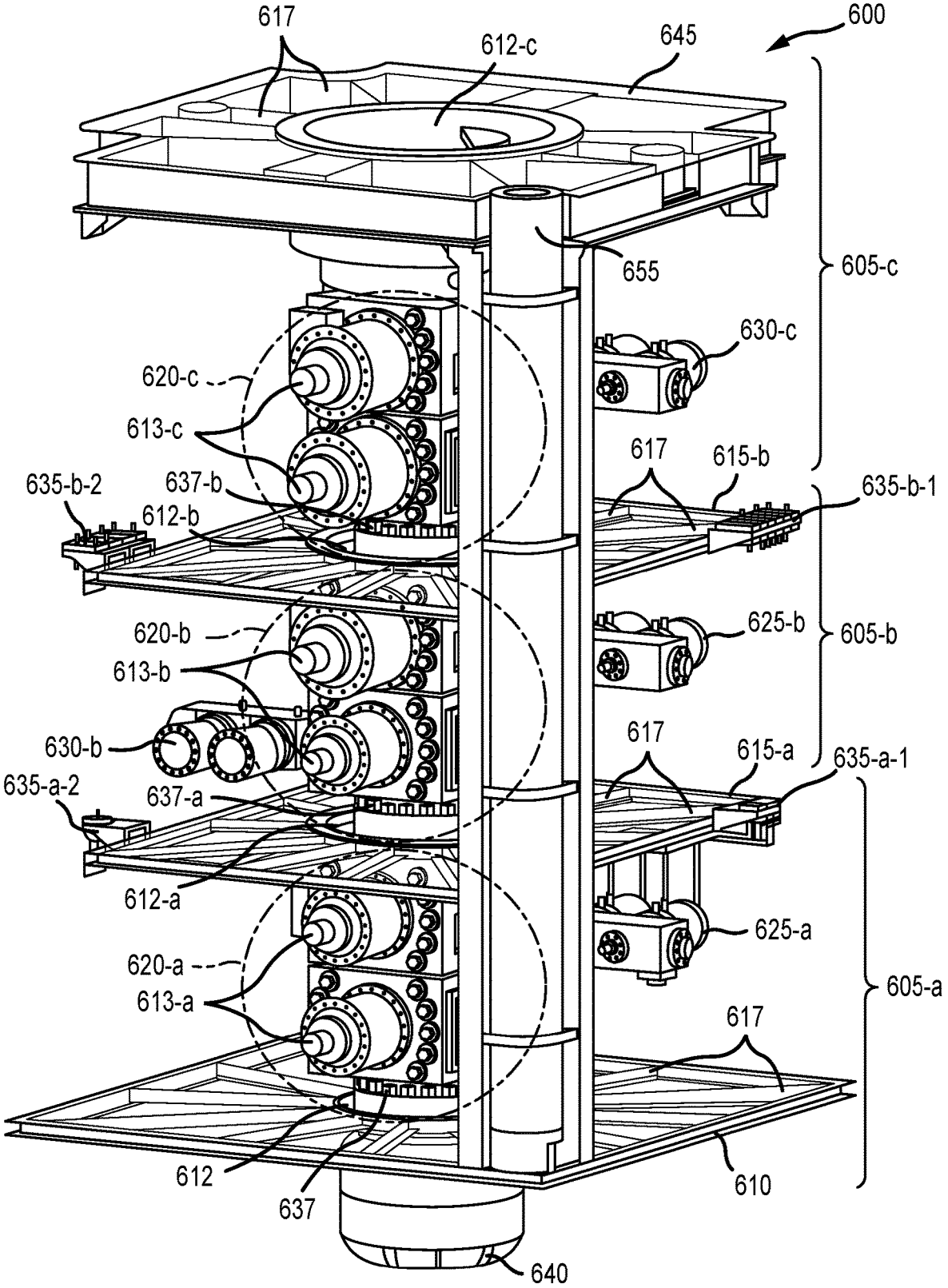
FIG. 6 is a perspective schematic view of a configurable BOP stack, according to an embodiment.
Figure 7:
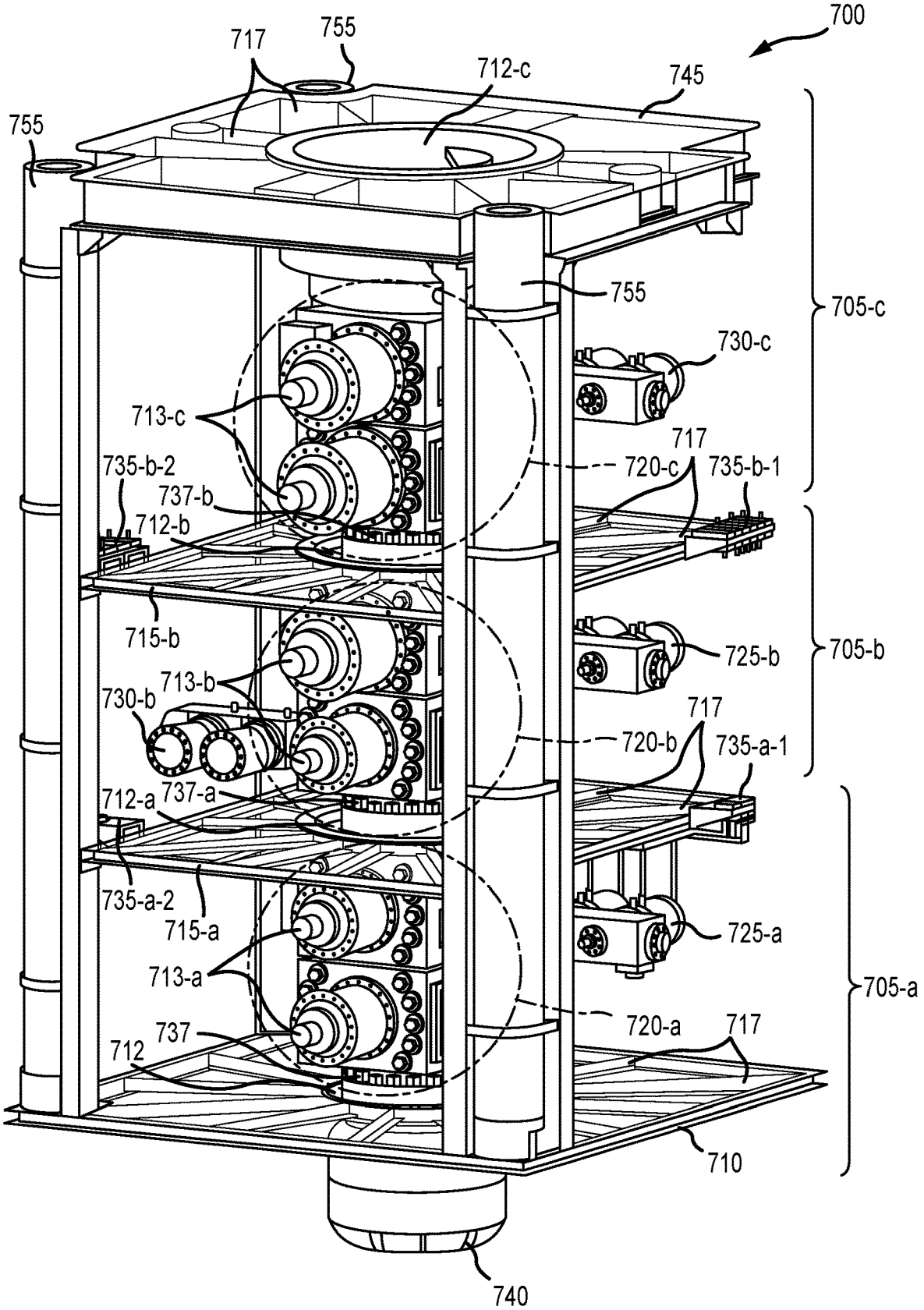
FIG. 7 is a perspective schematic view of a configurable BOP stack, according to an embodiment.
Figure 8:
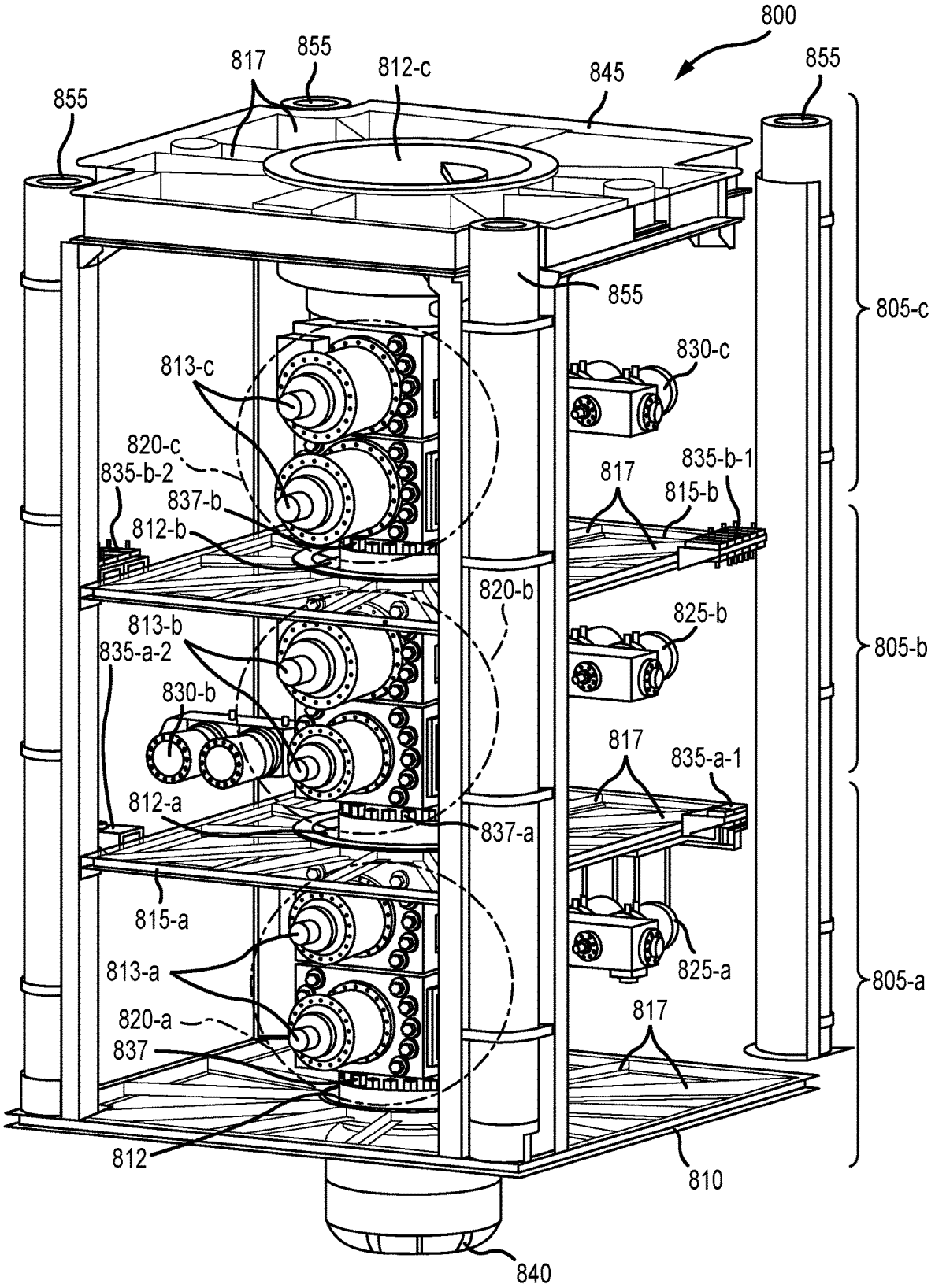
FIG. 8 is a perspective schematic view of a configurable BOP stack, according to an embodiment.

FIG. 5 illustrates an example BOP stack assembly 500 having three BOP ram cavity sets 505-*a*, 505-*b*, 505-*c*, according to an embodiment. BOP ram cavity sets 505-*a*, 505-*b*, and all associated components, can be examples of similarly numbered components as illustrated in the embodiment of FIG. 4. For example, bottommost BOP ram cavity set 505-*a* can be connected to a lower frame level 510 via connectors 537. Lower frame level 510 can fluidly couple bottommost BOP ram cavity set 505-*a* to wellhead connector 540 through an opening 512 in lower frame level 510. Bottommost BOP ram cavity set 505-*a* can include BOP 520-*a*, choke valve or kill valve 525-*a*, BOP ram cavities 513-*a*, and frame level 515-*a*. Frame level 515-*a* can include two junction plates 535-*a*-1, 535-*a*-2 in the illustrated example.

Second BOP ram cavity set 505-*b* can include BOP 520-*b*, BOP ram cavities 513-*b*, and frame level 515-*b*. Second BOP ram cavity set 505-*b* can also include choke valve or kill valves 525-*b* and choke valve or kill valves 530-*b*. Frame level 515-*b* can include two junction plates 535-*b*-1, 535-*b*-2, which can couple hydraulic piping from choke valve or kill valves 525-*b* and choke valve or kill valves 530-*b* on second BOP ram cavity set 505-*b* with hydraulic piping from choke valve or kill valves 525-*a* on bottommost BOP ram cavity set 505-*a*. The two junction plates 535-*b*-1, 535-*b*-2 can further couple hydraulic piping from choke valve or kill valves 525-*b* and choke valve or kill valves 530-*b* on second BOP ram cavity set 505-*b* with hydraulic piping from choke valve or kill valves 530-*c* on third BOP ram cavity set 505-*c*, as discussed in more detail below with respect to FIGS. 10A-10C.

Third BOP ram cavity set 505-*c* can be coupled to second BOP ram cavity set 505-*b*, and can be fluidly connected to wellhead connector 540 through openings 512, 512-*a*, 512-*b* and connectors 537, 537-*a*, 537-*b*. Like second BOP ram cavity set 505-*b* and bottommost BOP ram cavity set 505-*a*, third BOP ram cavity set 505-*c* can include BOP 520-*c* and BOP ram cavities 513-*c*. Third BOP ram cavity set 505-*c* can also include choke valve or kill valves 530-*c*.

Unlike second BOP ram cavity set 505-*b* and bottommost BOP ram cavity set 505-*a*, however, third BOP ram cavity set 505-*c* does not include a frame level. Instead, because third BOP ram cavity set 505-*c* is the uppermost BOP ram cavity set in the example BOP stack 500 illustrated in FIG. 5, BOP ram 520-*c* can be topped by upper frame level 545. Upper frame level 545 can have a similar construction to that of lower frame level 510. For example, upper frame level 545 can include a plurality of reinforcing members 517 radiating outwardly from a central opening 512-*c*. In other embodiments, upper frame level 545 can be constructed to have a different shape or configuration with respect to the upper frame level 545 and with respect to the central opening 512-*c*.

In the illustrated example BOP stack 500, the addition of third BOP ram cavity set 505-*c* and upper frame level 545 can complete the BOP stack, with respect to the BOP ram cavity sets. The BOP stack 500 illustrated in FIG. 5 can accordingly include three BOPs 520-*a*, 520-*b*, 520-*c*, and each BOP can include two BOP ram cavities 513, for a total of six BOP ram cavities 513. The illustrated BOP stack 500 can also include choke valve or kill valves 525-*a*, 525-*b*, 530-*b*, 530-*c*. This BOP stack 500 can be configured based on consumer or situational requirements. In other embodiments, different numbers and combinations of BOPs, BOP ram cavities, and choke valve or kill valves can be included. The modular nature of each BOP ram cavity set 505-*a*, 505-*b*, 505-*c* allows for such varied configurations.

FIGS. 6-9 illustrate examples of the next steps in assembling the modular BOP stack 600-900. After the desired number and configuration of BOP ram cavity sets 605-*a*, 605-*b*, 605-*c* have been assembled, vertical accumulator portals 655, 755, 855, 955 can be added to each corner of the BOP stack 600-900 to stabilize and structurally support the BOP stack 600-900. Accumulator portals 655, 755, 855, 955 can be hollow vertical posts, and can store hydraulic energy associated with the BOP stack by hydraulically connecting components of the BOP stack 600-900 to each other, and hydraulically connecting components of the BOP stack to other components of the system 100 as illustrated and discussed with respect to FIG. 1.

The length of the accumulator portals 655, 755, 855, 955 can coincide with the height of the BOP stack 600-900. As the number of BOP ram cavity sets 605-*a*, 605-*b*, 605-*c* in the BOP stack 600 varies, the height of the BOP stack 600 will also vary; appropriate accumulator portals 655 having lengths coinciding with the height of the BOP stack 600 can be selected accordingly.

In the illustrated example BOP stacks 600-900, accumulator portals 655, 755, 855, 955 can be coupled to each corner of the lower frame level 610, frame levels 615-*a*, 615-*b*, 615-*c*, 615-*d*, and upper frame level 645. In other embodiments, accumulator portals 655, 755, 855, 955 can be coupled to portions of the frame levels positioned between the corners of each frame level. The accumulator portals 655, 755, 855, 955 can act as emergency hydraulic supply to the BOP stacks 600-900.

FIG. 9 illustrates an example of a completed modular BOP stack 900, according to an embodiment. As shown, the completed BOP stack 900 includes three BOP ram cavity sets 905-*a*, 905-*b*, 905-*c* fluidly coupled together through openings 912-*a*, 912-*b* via connectors 937, 937-*a*, 937-*b*, and positioned between lower frame level 910 and upper frame level 945. The completed modular BOP stack 900 is flanked by accumulator portals 955 positioned at each corner of the lower frame level 910 and upper frame level 945, and abutting each corner of frame levels 915-*a*, 915-*b*.

The illustrated completed modular BOP stack 900 can include two BOP ram cavities 913 for each BOP ram cavity set 905-*a*, 905-*b*, 905-*c*, for a total of six BOP ram cavities 913. The illustrated BOP stack can also include choke valve or kill valves 925-*a*, 925-*b*, 930-*b*, 930-*c*. Frame levels 915-*a*, 915-*b* can each include two junction plates 935-*a*-1, 935-*a*-2 and junction plates 935-*b*-1, 935-*b*-2, respectively. The junction plates 935-*a*-1, 935-*a*-2, 935-*b*-1, 935-*b*-2 can couple hydraulic energy associated with choke valve or kill valves 925-*a*, 925-*b*, 930-*b*, 930-*c* via hydraulic piping, as illustrated and discussed in more detail below with respect to FIGS. 10A-10C.

Although illustrated in FIG. 9 as having the described configuration, in other embodiments, alternate BOP stack assembly configurations are contemplated. For example, in alternate embodiments, different numbers and configurations of BOP ram cavity sets, BOP rams, and choke valve or kill valves can be included, depending on particular situational or consumer requirements. The modular nature of the BOP ram cavity sets allows for such reconfiguration and assembly, according to changing individual needs.

Figure 10A:
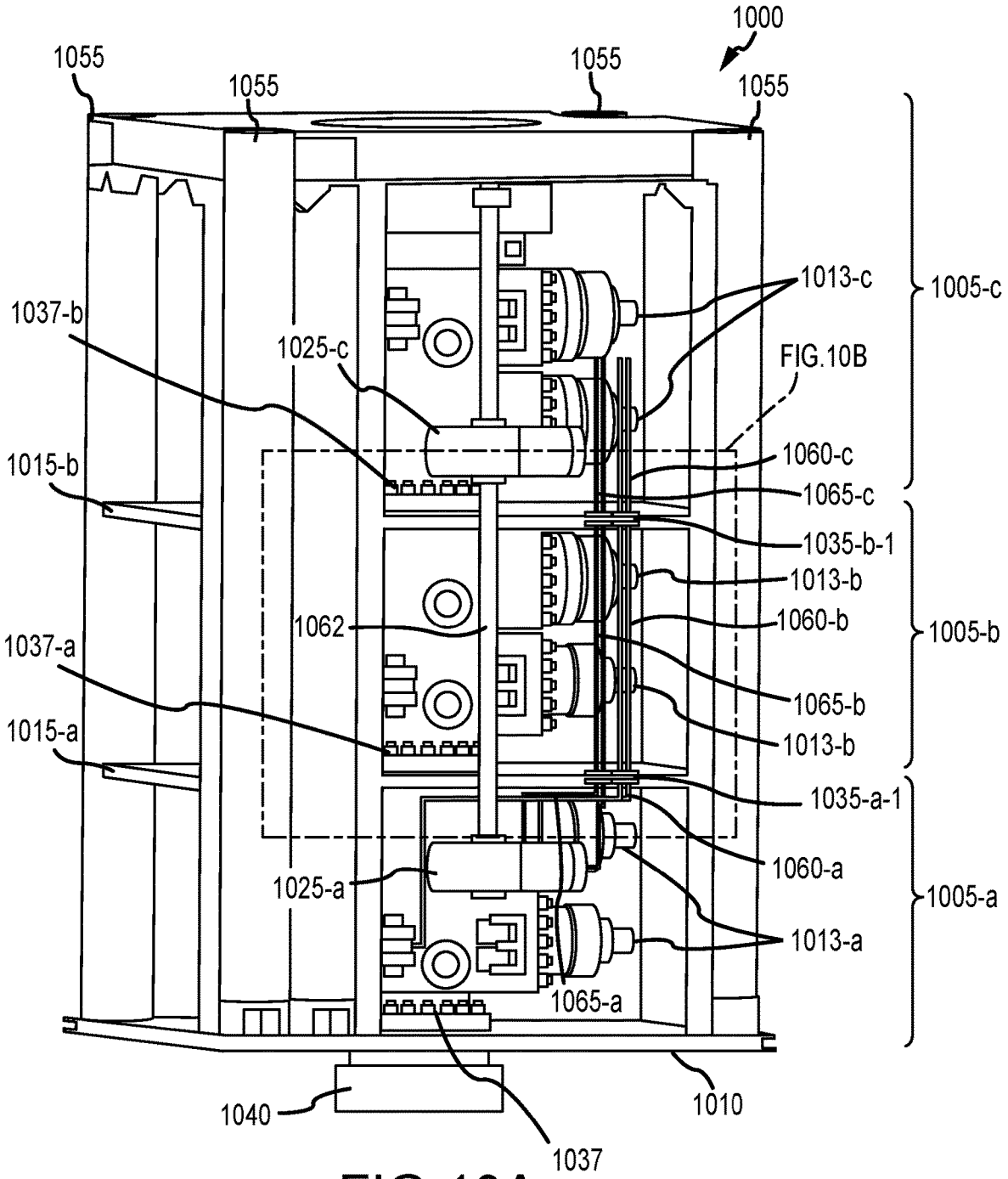
FIGS. 10A-10C are partial schematic views of a portion of a configurable BOP stack, according to an embodiment.
Figure 10B:
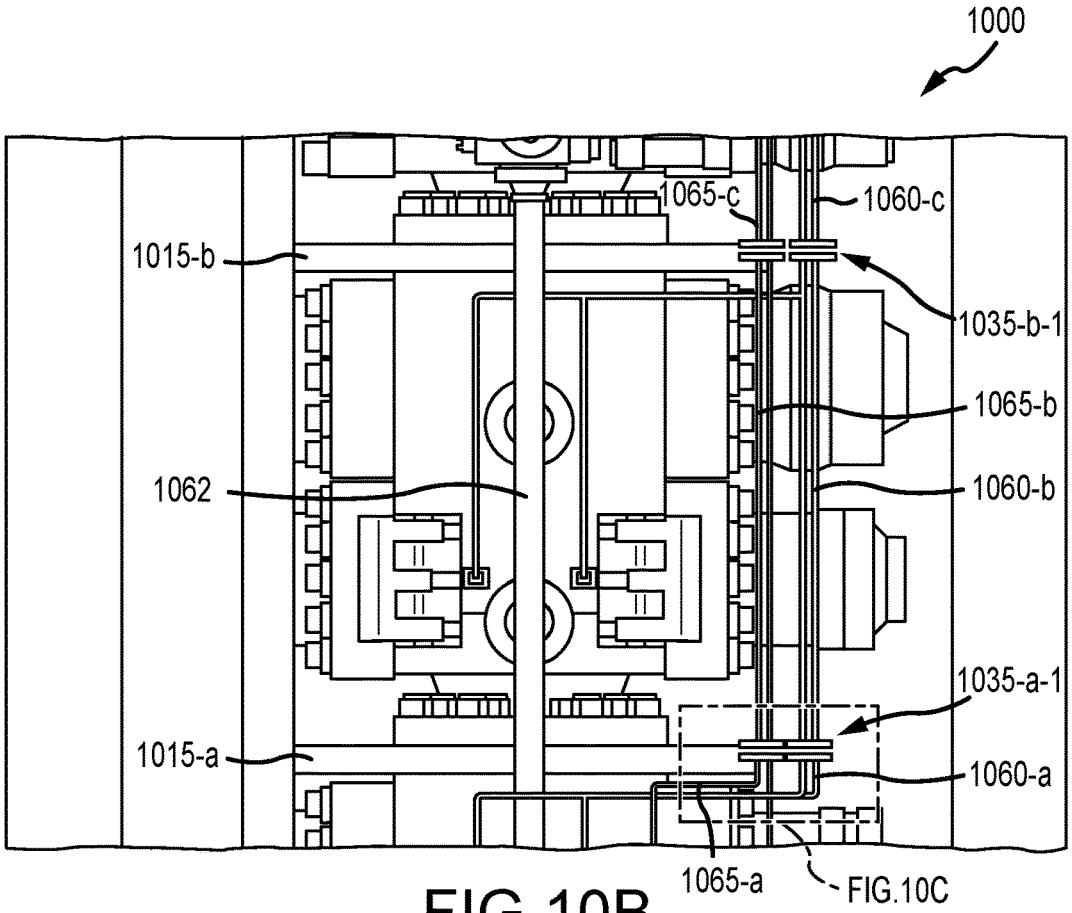
Figure 10C:
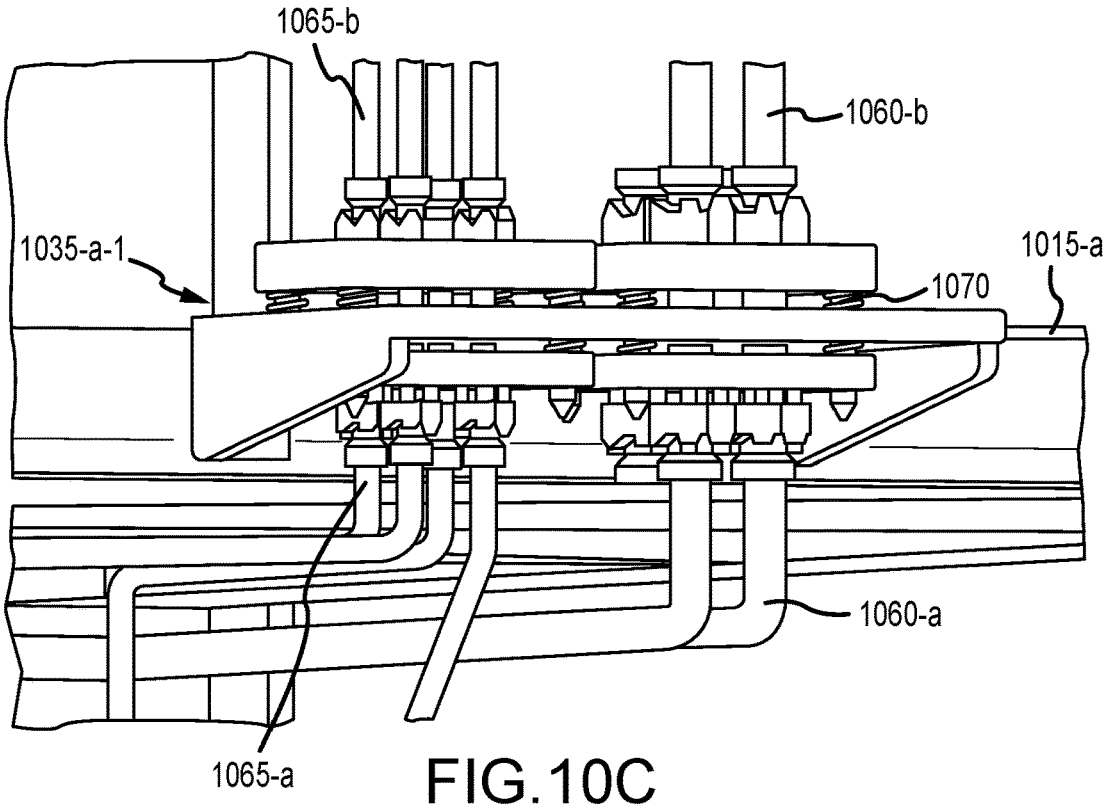

FIGS. 10A-10C illustrate detailed views of an example of junction plates 1035-*a*-1, 1035-*b*-1, which can be examples of junction plates 935-*a*-1, 935-*b*-1 as illustrated in FIG. 9. As illustrated in FIG. 10A, the completed BOP stack 1000, as similarly illustrated in example 900 of FIG. 9, includes three BOP ram cavity sets 1005-*a*, 1005-*b*, 1005-*c*. Bottommost BOP ram cavity set 1005-*a* can include two BOP ram cavities 1013-*a*; second BOP ram cavity set 1005-*b* can include two BOP ram cavities 1013-*b*; and uppermost BOP ram cavity set 1005-*c* can include two BOP ram cavities 1013-*c*.

Bottommost BOP ram cavity set 1005-*a* is shown coupled to wellhead connector 1040 via connectors 1037 in lower frame level 1010, and uppermost BOP ram cavity set 1005-*c* is shown coupled to upper frame level 1045. Bottommost BOP ram cavity set 1005-*a* can also be coupled to second BOP ram cavity set 1005-*b* via connectors 1037-*a* in frame level 1015-*a*, and second BOP ram cavity set 1005-*b* can be coupled to uppermost BOP ram cavity set 1005-*c* via connectors 1037-*b* in frame level 1015-*b*.

Lower frame level 1010, bottommost BOP ram cavity set 1005-*a*, frame level 1015-*a*, second BOP ram cavity set 1005-*b*, frame level 1015-*b*, uppermost BOP ram cavity set 1005-*c*, and upper frame level 1045 are illustrated in FIG. 10A as being connected and flanked by four vertical accumulator portals 1055, positioned at the distal corners of each of the frame levels, respectively.

Bottommost BOP ram cavity set 1005-*a* can include choke valve or kill valve 1025-*a*, and uppermost BOP ram cavity set 1005-*c* can include choke valve or kill valve 1025-*c*. Hydraulic piping 1062 can also be connected to, and allow for receipt of control signals from, control pod 132 as described above with respect to FIG. 1. Additionally, BOP rams 1013-*a*, 1013-*b*, 1013-*c* can be interconnected with each other and with choke valve or kill valves 1025-*a*, 1025-*c* via multiple sets of hydraulic piping 1060-*a*, 1060-*b*, 1060-*c*, as discussed in more detail below.

Frame level 1015-*a* can include junction plates 1035-*a*-1 and junction plates 1035-*a*-2 (the latter not visible in the illustrated view), and frame level 1015-*b* can include junction plates 1035-*b*-1 and junction plates 1035-*b*-2 (the latter not visible in the illustrated view). Junction plates 1035-*a*-1, 1035-*b*-1 can allow for easy configuration of the modular components of the BOP stack 1000. In particular, junction plates 1035-*a*-1, 1035-*b*-1 can be provided to couple the multiple sets of hydraulic piping 1060-*a*, 1060-*b*, 1060-*c* between adjacent connected BOP ram cavity sets 1005-*a*, 1005-*b*, 1005-*c*. For example, junction plate 1035-*a*-1 can couple hydraulic piping 1060-*a*, connected to BOP ram cavities 1013-*a*, to hydraulic piping 1060-*b*, connected to BOP ram cavities 1013-*b*. Similarly, junction plate 1035-*b*-1 can couple hydraulic piping 1060-*b*, connected to BOP ram cavities 1013-*b*, to hydraulic piping 1060-*c*, connected to BOP ram cavities 1013-*c*.

Junction plates 1035-*a*-1, 1035-*b*-1 can facilitate connection between the hydraulic piping 1060-*a*, 1060-*b*, 1060-*c* associated with adjacent BOP ram cavities through the use of quick-connect couplers, nuts, screws, or any combination of suitable coupling means, positioned on each junction plate, such that adjacent sets of hydraulic piping can be easily coupled when brought into contact with each other. For example, when assembling the BOP stack 1000 illustrated in FIG. 10, for example by the process illustrated in FIGS. 2-9, second BOP ram cavity set 1005-*b* can be aligned with and centered over bottommost BOP ram cavity set 1005-*a*, and second BOP ram cavity set 1005-*b* can be brought into contact with bottommost BOP ram cavity set 1005-*a* at the interface between BOP 1020-*b* and connectors 1037-*a*. In addition to the coupling of connectors 1037-*a* positioned on frame level 1015-*a* with BOP 1020-*b* of second BOP ram cavity set 1005-*b*, hydraulic piping 1060-*a* can couple with hydraulic piping 1060-*b* via the quick-connect couplers positioned at junction plate 1035-*a*-1.

Similarly, uppermost BOP ram cavity set 1005-*c* can be aligned with and centered over second BOP ram cavity set 1005-*b*, and uppermost BOP ram cavity set 1005-*c* can be brought into contact with second BOP ram cavity set 1005-*b* at the interface between BOP 1020-*c* and connectors 1037-*b*. In addition to the coupling of connectors 1037-*b* positioned on frame level 1015-*b* with BOP 1020-*c* of uppermost BOP ram cavity set 1005-*c*, hydraulic piping 1060-*b* can couple with hydraulic piping 1060-*c* via the quick-connect couplers positioned at junction plate 1035-*b*-1.

As illustrated in example 1000, junction plates 1035-*a*-1, 1035-*b*-1 can facilitate contact and connection between hydraulic piping 1060-*a*, 1060-*b*, 1060-*c* associated with choke valve or kill valves 1025-*a*, 1025-*c*, and can also facilitate contact and connection between hydraulic piping 1065-*a*, 1065-*b*, 1065-*c* associated with choke valve or kill valves 1030-*b*, 1030-*c* (the latter not visible in the illustrated view).

Figure 11:
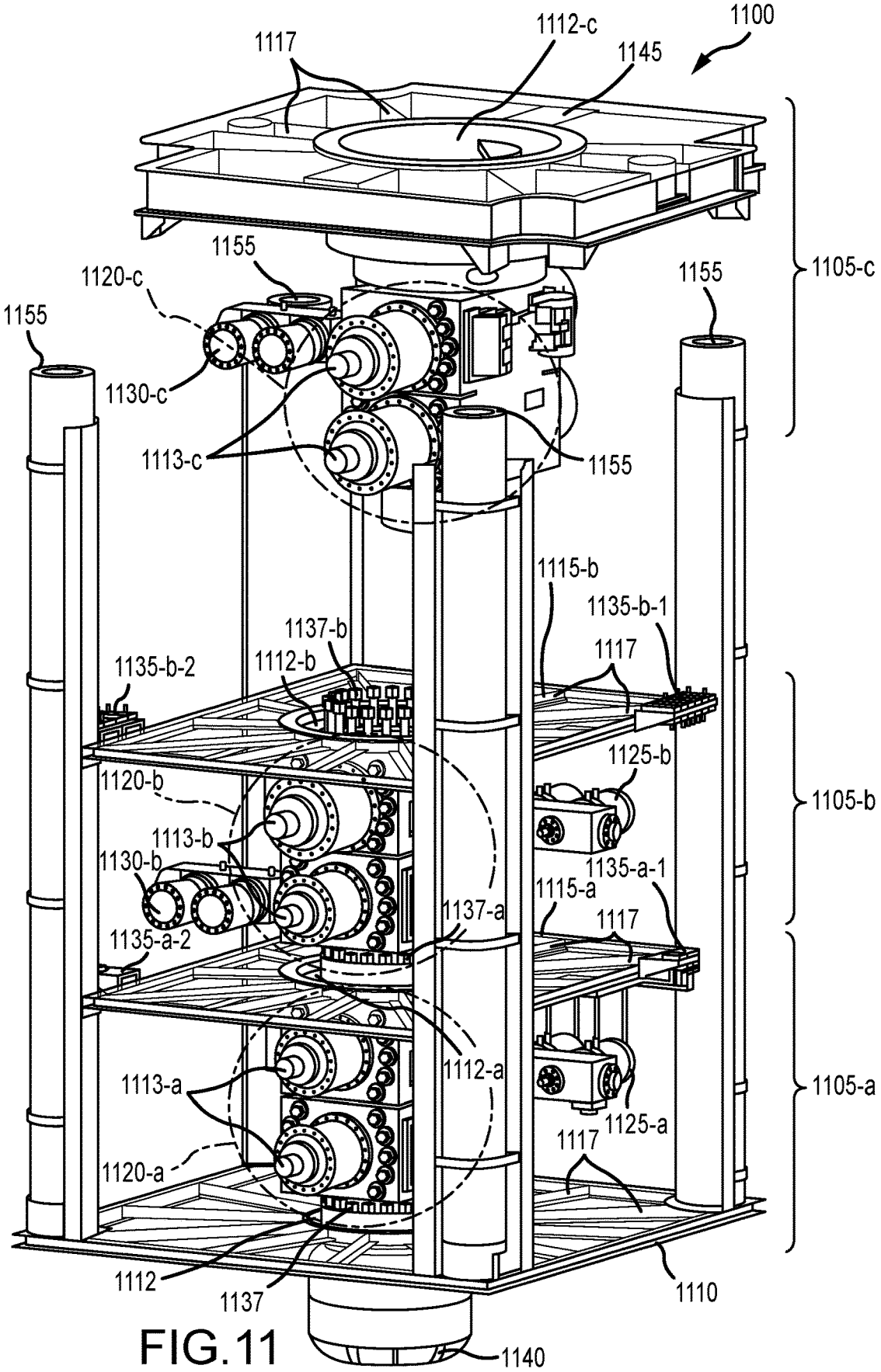
FIG. 11 is a perspective schematic view of a configurable BOP stack, according to an embodiment.
Figure 12:
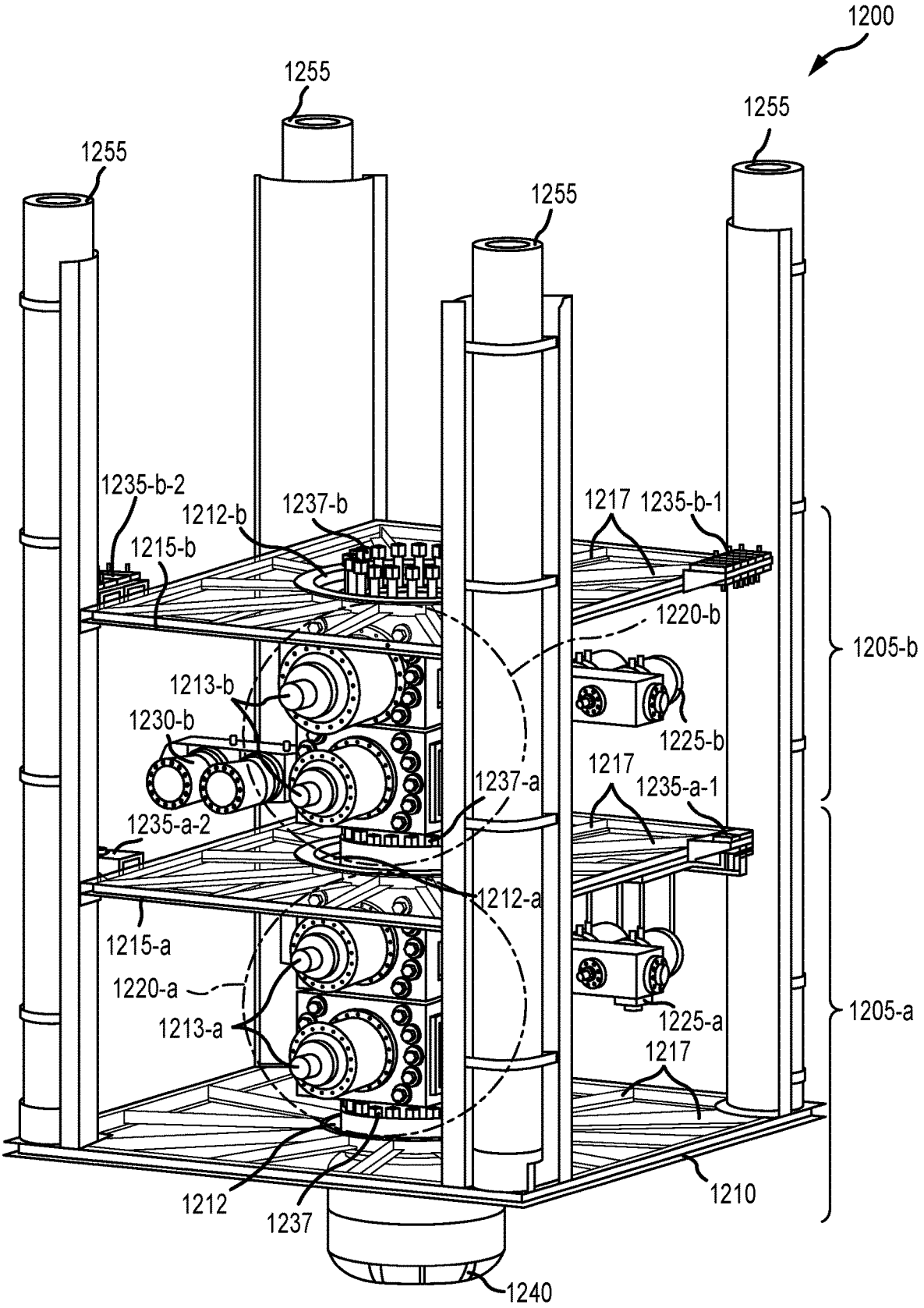
FIG. 12 is a perspective schematic view of a configurable BOP stack, according to an embodiment.

FIGS. 11-15 illustrate examples of a method of disassembling a BOP stack 1100 having six BOP ram cavities 1113, and reassembling the BOP stack 1500 to have seven BOP ram cavities 1513, according to an embodiment. Starting from the fully assembled BOP stack 900 illustrated in FIG. 9, in the example BOP stack 1100 illustrated in FIG. 11, the uppermost BOP ram cavity set 1105-*c*, connected to upper frame level 1145, can be uncoupled and removed from vertical accumulator portals 1155. Although disassembling the BOP stack is illustrated in the embodiments of FIGS. 11 and 12 as including removing the uppermost BOP ram cavity set, in other embodiments, disassembling the BOP stack can include removing the lowermost BOP ram cavity set, or a combination thereof.

FIG. 12 illustrates an example BOP stack 1200 in which uppermost BOP ram cavity set 1105-*c* and upper frame level 1145 have been removed from the BOP stack 1200, leaving behind bottommost BOP ram cavity set 1205-*a* and second BOP ram cavity set 1205-*b*, as well as lower frame level 1210 and four vertical accumulator portals 1255.

Figure 13:
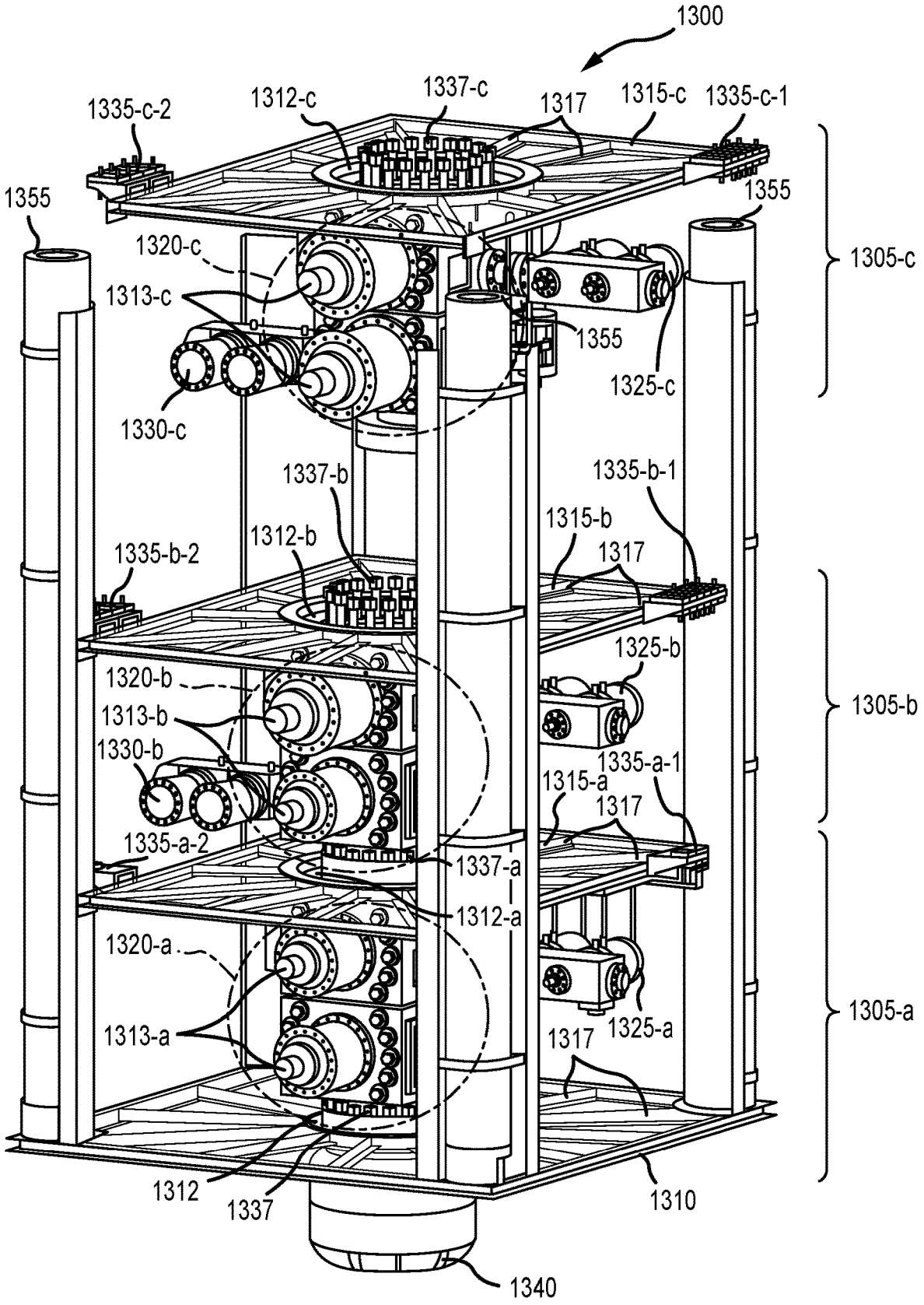
FIG. 13 is a perspective schematic view of a configurable BOP stack, according to an embodiment.

At this point, the BOP stack 1200 can be further disassembled, for example by removing second BOP ram cavity set 1205-*b*. Alternatively, as illustrated in FIG. 13, an example of a method for constructing a seven-ram cavity BOP stack 1500 is shown, according to an embodiment. As illustrated in FIG. 13, a third BOP ram cavity set 1305-*c* can be inserted on top of second BOP ram cavity set 1305-*b*. Unlike the uppermost BOP ram cavity set 1105-*c* illustrated in FIG. 11, which is coupled to an upper frame level 1145 to complete the BOP stack 1100, third BOP ram cavity set 1305-*c* is coupled to frame level 1315-*c*, such that one or more additional BOP ram cavity sets can be assembled above the third BOP ram cavity set 1305-*c* in the BOP stack 1300.

Figure 14:
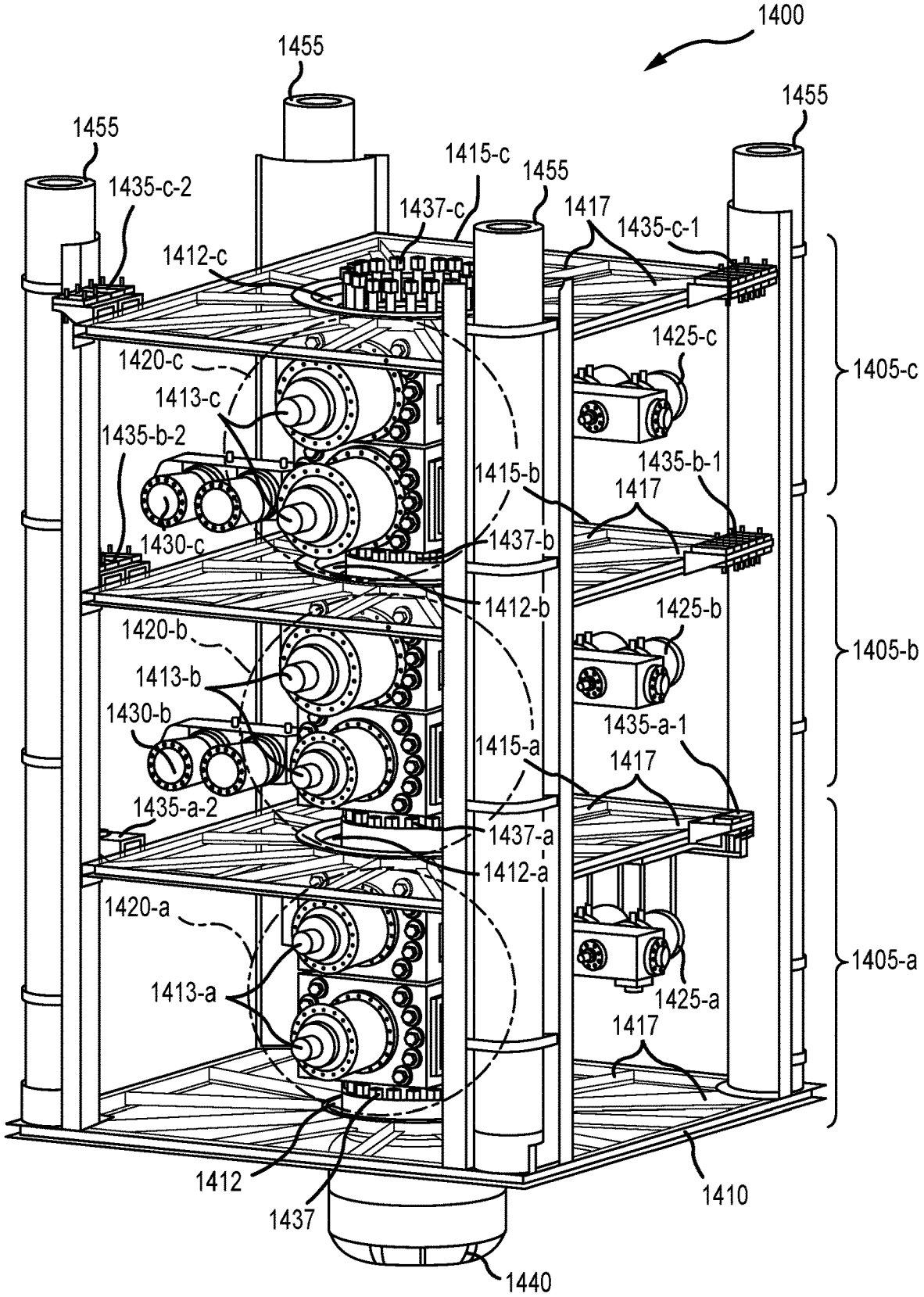
FIG. 14 is a perspective schematic view of a configurable BOP stack, according to an embodiment.

Third BOP ram cavity set 1305-*c* can be centered over and aligned with second BOP ram cavity set 1305-*b*, and BOP 1320-*c* can be lowered onto connectors 1337-*b* for coupling. FIG. 14 illustrates an example of the BOP stack 1400 having bottommost BOP ram cavity set 1405-*a*, second BOP ram cavity set 1405-*b*, and third BOP ram cavity set 1405-*c* assembled and connected by connectors 1437, 1437-*a*, 1437-*b*.

Figure 15:
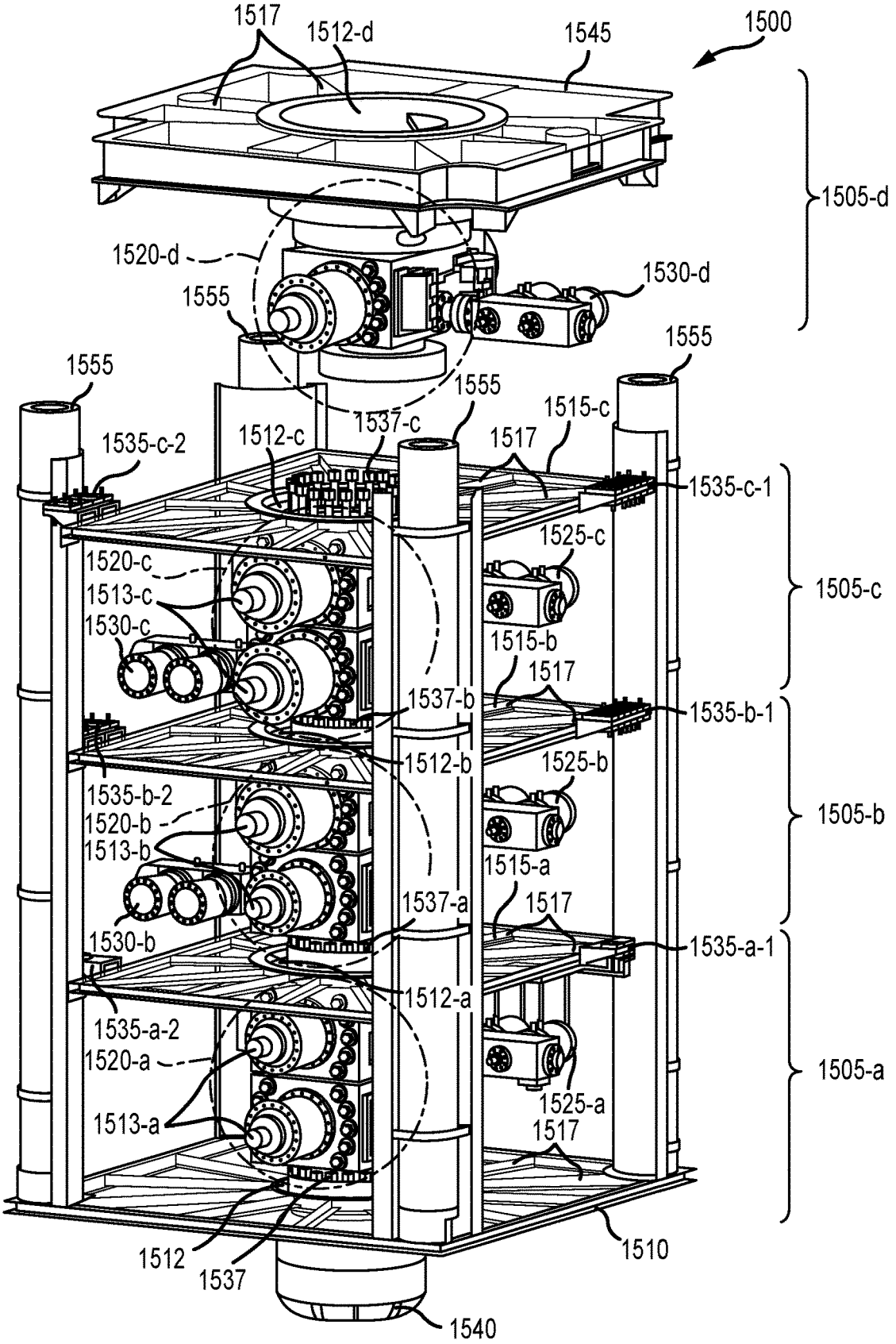
FIG. 15 is a perspective schematic view of a configurable BOP stack, according to an embodiment.

In FIG. 15, an uppermost BOP ram cavity set 1505-*d* can be coupled to the BOP stack 1500 to complete the BOP stack according to the illustrated example. In the illustrated example, the uppermost BOP ram cavity set 1505-*d* can include only a single BOP ram cavity 1513-*d*. In other examples, the uppermost BOP ram cavity set 1505-*d* can include two or more BOP ram cavities 1513-*d*. By coupling modular BOP ram cavity sets including differing numbers of BOP ram cavities, a BOP stack having a particular desired number of BOP ram cavities can be achieved.

Uppermost BOP ram cavity set 1505-*d* can be coupled to upper frame level 1545 to complete the BOP stack 1500. Uppermost BOP ram cavity set 1505-*d* can be centered over and aligned with third BOP ram cavity set 1505-*c*, and BOP 1520-*d* can be lowered onto connectors 1537-*c* for coupling. Each corner of upper frame level 1545 can be brought into alignment and contact with each vertical accumulator portal 1555 upon coupling of connectors 1537-*c* with BOP 1520-*d*, in order to stabilize the BOP stack 1500. Such connection will complete configuration of the BOP stack 1500. As illustrated, the BOP stack 1500 can include a total of seven BOP ram cavities 1513-*a*, 1513-*b*, 1513-*c*, 1513-*d*; and choke valve or kill valves 1525-*a*, 1525-*b*, 1525-*c*, 1530-*b*, 1530-*c*, 1530-*d*. In other embodiments, differing configurations and numbers of components in the BOP stack are contemplated, and can be achieved due to the modular design of the BOP ram cavity sets.

The present disclosure described herein, therefore, is well adapted to carry out the objects and attain the ends and advantages mentioned, as well as others inherent therein. While a presently preferred embodiment of the disclosure has been given for purposes of disclosure, numerous changes exist in the details of procedures for accomplishing the desired results. These and other similar modifications will readily suggest themselves to those skilled in the art, and are intended to be encompassed within the spirit of the present disclosure disclosed herein and the scope of the appended claims.

What is claimed is:

1. A configurable blowout preventer (BOP) system for use in oil and gas operations, the BOP system comprising:

two or more modular BOP ram cavity sets, each of the two or more modular BOP ram cavity sets comprising at least one BOP ram cavity;

one or more frame levels, each of the one or more frame levels separating each of the two or more modular BOP ram cavity sets and coupling each of the two or more modular BOP ram cavity sets together;

a plurality of hydraulic piping fluidly connected to each of the two or more modular BOP ram cavity sets, the plurality of hydraulic piping configured to drive operation of the two or more modular BOP ram cavity sets; and one or more junction plates positioned on each of the one or more frame levels, the one or more junction plates configured to couple the plurality of hydraulic piping between each of the two or more modular BOP ram cavity sets.

2. The BOP system of claim 1, wherein the one or more junction plates comprise connectors selected from the group consisting of any of screws, bolts, or quick-connect couplers, or a combination thereof.

3. The BOP system of claim 1, the BOP system further comprising one or more vertical accumulator portals.

4. The BOP system of claim 1, further comprising:

one or more choke valves or kill valves positioned on each of the two or more modular BOP ram cavity sets, wherein the plurality of hydraulic piping is further configured to drive operation of the one or more choke valves or kill valves.

5. The BOP system of claim 4, wherein the one or more choke valves or kill valves are controlled via the plurality of hydraulic piping by one or more control pods.

6. The BOP system of claim 1, further comprising one or more rams positioned in the at least one BOP ram cavity, the one or more rams selected from the group consisting of any of a pipe ram, a blind ram, a shear ram, a sealing ram, or a blind shear ram, or any combination thereof.

7. A configurable blowout preventer (BOP) system for use in oil and gas operations, the BOP system comprising:

two or more modular BOP ram cavity sets, the two or more modular BOP ram cavity sets being vertically stacked, and each of the two or more modular BOP ram cavity sets comprising at least one BOP ram cavity;

one or more frame levels, each of the one or more frame levels separating each of the two or more modular BOP ram cavity sets and coupling each of the two or more modular BOP ram cavity sets together;

a plurality of hydraulic piping fluidly connected to each of the two or more modular BOP ram cavity sets, the plurality of hydraulic piping configured to drive operation of the two or more modular BOP ram cavity sets; and one or more junction plates positioned on each of the one or more frame levels, the one or more junction plates configured to couple the plurality of hydraulic piping between each of the two or more modular BOP ram cavity sets.

8. The BOP system of claim 7, further comprising one or more choke valves or kill valves positioned on each of the two or more modular BOP ram cavity sets, wherein the plurality of hydraulic piping is further configured to drive operation of the one or more choke valves or kill valves.

9. The BOP system of claim 7, the BOP system further comprising one or more vertical accumulator portals.

10. The BOP system of claim 7, wherein the two or more stacked modular BOP ram cavity sets are fluidly connected to a wellhead connector at a lower end of the BOP system, and are fluidly connected to a riser at an upper end of the BOP system.

11. The BOP system of claim 10, further comprising:

a lower frame level positioned between the lower end of the BOP system and the wellhead connector; and an upper frame level positioned between the upper end of the BOP system and the riser.

12. A method for assembling a configurable blowout preventer (BOP) system for use in oil and gas operations, the method comprising:

stacking two or more modular BOP ram cavity sets, each of the two or more modular BOP ram cavity sets comprising at least one BOP ram cavity;

positioning a frame level between each of the two or more modular BOP ram cavity sets and coupling each of the two or more modular BOP ram cavity sets together with the frame level;

fluidly connecting a plurality of hydraulic piping to each of the two or more modular BOP ram cavity sets, the plurality of hydraulic piping configured to drive operation of the two or more modular BOP ram cavity sets; and positioning one or more junction plates on each of the frame levels, the one or more junction plates configured to couple the plurality of hydraulic piping between each of the two or more modular BOP ram cavity sets.

13. The method of claim 12, further comprising:

removing at least one of the two or more BOP ram cavity sets, the removing comprising disconnecting the plurality of hydraulic piping at the one or more junction plates on each of the frame levels positioned between the removed at least one BOP ram cavity set and an adjacent BOP ram cavity set.

14. The method of claim 13, further comprising:

replacing the removed at least one of the two or more BOP ram cavity sets with one or more alternate BOP ram cavity set, the replacing comprising coupling the plurality of hydraulic piping at the one or more junction plates on each of the frame levels positioned between the replaced at least one BOP ram cavity set and an adjacent BOP ram cavity set.

15. The method of claim 12, further comprising:

connecting an upper frame level to an upper end of the BOP system.

16. The method of claim 15, further comprising:

fluidly coupling the upper frame level to a riser.

17. The method of claim 12, further comprising:

connecting a lower frame level to a lower end of the BOP system.

* * * * *